US008042558B2

(12) United States Patent
Kuge et al.

(10) Patent No.: US 8,042,558 B2
(45) Date of Patent: Oct. 25, 2011

(54) HIGH-PRESSURE WATER CLEANING SYSTEM

(75) Inventors: Morimasa Kuge, Kobe (JP); Keiji Tsujita, Kobe (JP); Eiji Noutomi, Tokyo (JP); Hideyuki Tanaka, Kobe (JP); Mitsuru Nomura, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 583 days.

(21) Appl. No.: 12/262,095

(22) Filed: Oct. 30, 2008

(65) Prior Publication Data

US 2009/0107531 A1 Apr. 30, 2009

(30) Foreign Application Priority Data

Oct. 30, 2007 (JP) ..... 2007-281322

(51) Int. Cl.
*B08B 3/02* (2006.01)

(52) U.S. Cl. ..... 134/68; 134/64 R; 134/72; 134/122 R; 134/131

(58) Field of Classification Search ..... 134/64 R, 134/68, 69, 72, 122 R, 131; 68/205 R
See application file for complete search history.

(56) References Cited

U.S. PATENT DOCUMENTS 2,622,428 A * 12/1952 Abbott ..... 69/32

FOREIGN PATENT DOCUMENTS

| | | | |
|---|---|---|---|
| EP | 1 719 561 A1 | | 11/2006 |
| JP | 2705719 | | 10/1997 |
| JP | 2000223458 | * | 8/2000 |
| JP | 2000223458 A | | 8/2000 |
| JP | 2002-166235 | | 6/2002 |
| JP | 2006297207 A | | 11/2006 |

* cited by examiner

*Primary Examiner* — Michael Barr
*Assistant Examiner* — Saeed T Chaudhry
(74) *Attorney, Agent, or Firm* — Alleman Hall McCoy Russell & Tuttle LLP

(57) ABSTRACT

A high-pressure water cleaning system includes a cleaning main body, a support frame member having a length which is larger than a width of an object, the support frame member being supported at extended end portions thereof at both sides by bearing units and eccentric rotational shafts such that the support frame member is eccentrically rotatable, the eccentric rotatable shafts being configured to rotate to cause the support frame member to perform rotational motion, a plurality of high-pressure water ejecting nozzles which are arranged on the surface of the support frame member to be equally spaced apart from each other and are directed to face the object, and a drive device configured to cause the eccentric rotational shafts to rotate. The high-pressure water ejecting nozzles are supplied with the high-pressure water and eject the high-pressure water to the object being moved at the constant speed while performing the rotational motion.

19 Claims, 23 Drawing Sheets

HIGH-PRESSURE WATER CLEANING SYSTEM

TECHNICAL FIELD

The present invention relates to a high-pressure water cleaning system (also referred to as a water jet cleaner) which is configured to eject high-pressure water to flat plate materials such as FPDs (flat panel displays) such as liquid crystal panels, plasma panels, or organic EL (electric luminance) panels, glasses, or semiconductor wafers to clean them. For more details, the present invention relates to a cleaning system configured to remove, with the high-pressure water, contamination matters such as fine particles, organic matters, metal impurities on surfaces of glass substrates, which are a cause of a reduced yield, in a step of manufacturing liquid crystal displays, semiconductor wafers, etc.

BACKGROUND ART

Turning to FIG. 25A, such a high-pressure water cleaning system is shown, to include a nozzle holder 71 provided with seven high-pressure water ejecting nozzles 72 arranged to be equi-angularly spaced apart from each other in a circumferential direction thereof. Each nozzle 72 has one nozzle hole 73 at a center thereof. The cleaning system is configured as a set of a cleaning gun (water jet gun) 70 which carries out cleaning by rotating (orbital motion) the nozzle holder 71. FIG. 25B is a view showing a cleaning trajectory of one high-pressure water ejecting nozzle 72. Turning to FIG. 24, a plurality of (e.g., about fifteen) cleaning guns 70 are arranged at equal intervals on a frame member 74 in the longitudinal direction thereof. An object X, such as a glass plate, is moved at a constant speed across the high-pressure water ejected from the cleaning gun 70, i.e., nozzle arrangement. Thus, the object X is cleaned. In FIG. 24, reference numeral 75 denotes a drive device, for example, a servo motor.

The aforementioned cleaning gun 70 for use in the high-pressure water cleaning system has, for instance, a holder provided with a high-pressure water ejecting nozzle at a tip end of a casing. In the high-pressure water cleaning system in which a high-pressure water tube is coupled to the holder, a support shaft is rotatably supported in the interior of the casing, a bearing whose bearing surface is pivotable is mounted to the support shaft and rotatably supports the holder at a base end thereof, and a swash plate is provided between a rear end surface of the holder and the support shaft such that the swash plate is rotatable together with the support shaft and slidably contacts the rear end surface of the holder.

According to this cleaning gun, when the swash plate provided between the rear end surface of the holder and the support shaft is rotated together with the support shaft in the state where the holder provided with the high-pressure water ejecting nozzles is rotatably supported at the base end side thereof by the bearing of the support shaft rotatably mounted in the interior of the casing, the holder sliding along the swash plate moves around to draw a conical shape, under the state where the spin of the holder is restricted by the high-pressure water tube. In this case, the inclination of the holder is absorbed by the pivot operation of the bearing surface. Therefore, a high-pressure water cleaning operation is carried out in such a manner that the high-pressure water ejecting nozzle provided at the tip end of the holder ejects the high-pressure water in a conical shape. Such a system is disclosed in Japanese Patent No. 2705719, the entire disclosure of which is incorporated herein by reference.

As another prior art of the high-pressure water cleaning system, a cleaning system is disclosed in Japanese Laid-Open Patent Application Publication No. 2002-166235, in which a plurality of high-pressure water ejecting nozzle heads each having a plurality of nozzles are provided above a cleaning conveyor to eject high-pressure water to an object which is conveyed by the cleaning conveyor to be transported into a cleaning chamber, and eject the high-pressure water from the nozzles while rotating. In this system, motors are mounted at a location isolated from the cleaning chamber to independently rotate associated high-pressure water ejecting nozzle heads.

However, the above described conventional high-pressure water cleaning systems are unable to achieve desired cleanliness, high-speed, cleaning uniformity, etc., for the reasons stated below.

One drive motor is built into each cleaning gun. Therefore, rotation driving members such as a bearing and a timing belt, namely, dust generating members, are located within a cleaning area in the cleaning system. In the cleaning gun, dust is generated chiefly from a rotation sealing part. This makes it difficult to achieve a cleanliness of about class 10 (US Federal standard 209D) which is required in, for example, a manufacturing line of liquid crystal panels.

The rotational speed of each nozzle holder (high-pressure water ejecting nozzle) is 1500 rpm. As can be seen from shading in FIG. 25B, the movement trajectory of the high-pressure water shows non-uniformity in cleaning strength in the width direction of the cleaning area, (i.e., the longitudinal direction), leaving a non-uniformly cleaned region on the object X. If the cleaning strength, in particular, the strength of the high-pressure water for cleaning is non-uniform, a circuit board mounted on a glass surface in the liquid crystal panel may be damaged. FIG. 25B shows the movement trajectory of the cleaning water ejected from one nozzle. As shown in FIG. 25B, a region of the width of the movement trajectory of the cleaning water in the state where the nozzles partially overlap with each other is cleaned. Since the cleaning system is provided with the plurality of nozzle head units, the cleaning trajectory of the cleaning system is formed by gathering a plurality of cleaning trajectories of the nozzles.

Since it is necessary to build the servo motor or the rotation device into each cleaning gun, a cost cannot be reduced. In addition, building the devices into the cleaning area and piping or wiring operation are time consuming and troublesome.

The system disclosed in the publication No. 2002-166235 is intended to clean construction erection materials such as a scaffold or a scaffold frame and is different from the objects handled by the present invention. In addition, the system is less suited for cleaning which requires high cleanliness mentioned above.

SUMMARY OF THE INVENTION

The present invention addresses the above described conditions, and an object of the present invention is to provide a high-pressure water cleaning system which is capable of easily achieving a cleanliness desired in a manufacturing line, of achieving uniform cleaning, of having a simple structure to reduce a manufacturing cost, and of reducing vibration generated in the cleaning system during cleaning objects, and a high-pressure water cleaning method thereof.

According to an aspect of the present invention, there is provided a high-pressure water cleaning system, having a cleaning main body, the cleaning system being configured to eject high-pressure water from the cleaning main body to an object to clean the object, while moving the object at a constant speed with respect to the cleaning main body, comprising a common support frame member having a length which is larger than a width of the object, the support frame member being supported at extended end portions thereof at both sides by bearing units and eccentric rotational shafts extending in a direction perpendicular to a surface of an extended plane of the support frame member or perpendicular to a surface of the object such that the support frame member is eccentrically rotatable, the eccentric rotatable shafts being configured to rotate to cause the support frame member of the cleaning main body to perform rotational motion; a plurality of high-pressure water ejecting nozzles which are arranged on the surface of the support frame member to be equally spaced apart from each other and are directed to face the object; and a drive device configured to cause the eccentric rotational shafts to rotate; wherein the high-pressure water ejecting nozzles are supplied with the high-pressure water through a water passage extending along the support frame member and are configured to eject the high-pressure water to the object being moved at the constant speed while performing the rotational motion.

The above-configured high-pressure water cleaning system has a plurality of high-pressure water ejecting nozzles arranged on the surface of the common support frame member and is eccentrically rotationally supported at the extended end portions at both sides and is eccentrically rotated by the drive device. Since an eccentric rotation drive apparatus to be described later is disposed outside the cleaning area in which the plurality of ejecting nozzles are located, dust generating components or members do not exist in the cleaning area.

Therefore, cleaning operation with high cleanliness is achieved. For this reason, the high-pressure water cleaning system is easily adapted to the cleaning which requires high cleanliness (10 to 100), for example, cleaning of FPDs or semiconductor wafers. Since the plurality of high-pressure water ejecting nozzles are arranged on the surface of the common support frame member and eject the high-pressure water to the object while performing rotational motion (e.g., rotate to draw a perfect circle with an eccentric amount (radius) r around a center location), the object is cleaned with a uniform cleaning strength by ejecting, to the object, the high-pressure water in a straight-line shape from the nozzles arranged to be equally spaced apart from each other. This makes it possible to maintain a constant cleaning force to clean an object which requires uniform cleaning, such as a glass substrate, and to avoid damaging the object. Furthermore, in contrast to the configuration in which each nozzle is independently rotated by the drive device to clean the object, the high-pressure water cleaning system has a simple structure and is easily assembled, and a piping operation and a wiring operation are not time-consuming and troublesome. As a result, a cost of the high-pressure water cleaning system can be reduced.

It is preferable that the high-pressure water cleaning system may further comprise a second drive device configured to cause the eccentric rotational shafts to rotate, and an eccentric rotation drive apparatus disposed outside a cleaning area of the object, and including at least one of the drive devices provided at each of the extended end portions of the support frame member.

In such a configuration, since the eccentric rotation drive apparatus which tends to generate dust is disposed outside the cleaning area, the high-pressure water cleaning system can easily improve the cleanliness in the cleaning area.

Each of the high-pressure water ejecting nozzles may have a nozzle hole which is formed in a center position thereof to extend in a direction perpendicular to a tip end surface thereof. One end of a high-pressure water supply passage extending along the support frame member may be coupled to a base end side of the nozzle holes of the high-pressure water ejecting nozzles, and an opposite end of the high-pressure water supply passage may be coupled to a high-pressure water source via a flexible metal-made pipe.

In such a configuration, the high-pressure water can be supplied uniformly, from the high-pressure water source, to the nozzles performing the rotational motion through the metal-made pipe, while absorbing displacement of the cleaning main body performing the rotational motion, and can be ejected uniformly to the entire object. As a result, efficient cleaning operation is achieved.

The high-pressure water cleaning system may further comprise a balance weight mounted to one surface of the support frame member which is opposite to the other surface on which the high-pressure water ejecting nozzles are provided so that a weight of an upper part and a weight of a lower part including the high-pressure water ejecting nozzles are balanced, the upper part and the lower part being defined by a center axis in a width direction of the support frame member.

In such a configuration, since the center of gravity of the cleaning main body is positioned on the center axis in the width direction of the support frame member, which is located between the ejecting nozzles and the one surface of the support frame member on which the balance weight is provided, a weight balance of the cleaning main body can be maintained during the operation of the high-pressure water cleaning system, particularly during the rotational motion of the cleaning main body. This makes it possible to avoid an undesired moment being generated on the cleaning main body and to reduce a vibration transmitted to the outside, particularly the eccentric rotation drive apparatus. As a result, a vibration generated in the entire cleaning system can be reduced. The high-pressure water cleaning system may further comprise an eccentric rotation drive apparatus including the drive device provided at each of the extended end portions of the support frame member, a rotational shaft eccentric member which is configured to couple the eccentric rotational shafts in a position eccentric from the center axis of the rotational shaft eccentric member such that the rotational shafts are integrally rotatable with the rotational shaft eccentric member, and wherein each bearing unit includes a bearing housing unit configured to rotatably support a corresponding one of the rotational shaft eccentric members. The bearing housing unit may be integrally coupled to one end of the support frame member via a coupling plate.

The high-pressure water cleaning system may further comprise a second drive device configured to cause the eccentric rotational shafts to rotate, and an eccentric rotation drive apparatus including at least one of the drive devices provided at each of the extended end portions of the support frame member, a rotational shaft eccentric member for at least one of the bearing units, the rotational shaft eccentric member being configured to couple an upper shaft and a lower shaft of a corresponding one of the eccentric rotational shafts in a position eccentric from the center axis of the rotational shaft eccentric member such that the upper shaft and lower shaft of the corresponding one of the eccentric rotational shafts are integrally rotatable with the rotational shaft eccentric member, and a bearing housing unit of at least one of the bearing units, configured to rotatably support the rotational shaft eccentric member. The bearing housing unit may be integrally coupled to one end of the support frame member via a coupling plate.

In such a configuration, since the eccentric rotation drive apparatus generates an eccentric rotational force at the extended end portions of the cleaning main body at both sides, the cleaning main body including the plurality of nozzles smoothly performs the rotational motion.

The rotational shaft eccentric member may be formed in a cylindrical shape and the upper shaft and the lower shaft of the corresponding one of the eccentric rotational shafts may be coupled to each other within the bearing housing unit in the position eccentric from the center axis of the cylindrical rotational shaft eccentric member such that the corresponding one of the eccentric rotational shafts are integrally rotatable with the rotational shaft eccentric member.

In such an operation, a relatively large eccentric amount is provided with respect to the center position of the cylindrical rotational shaft eccentric member. Further, since the rotational force of the eccentric rotational shafts is transmitted to the rotational shaft eccentric member to cause the rotational shaft eccentric member to eccentrically rotate with the rotational shaft eccentric member rotatably supported by the bearing housing unit, the rotational shaft eccentric member smoothly rotates so that the cleaning main body can perform the rotational motion.

The high-pressure water cleaning system may further comprise balance weights which are mounted to the upper shaft and lower shaft of the corresponding one of the eccentric rotational shafts to be integrally rotatable with the corresponding one of the eccentric rotational shafts, and wherein the balance weights are mounted at upper and lower positions with the eccentric rotational shaft member and the bearing housing unit interposed between the balance weights such that the balance weights are located on an opposite side of the center axis of the rotational shaft eccentric member with respect to a center axis of the corresponding eccentric rotational shafts in an eccentric direction of the support frame member to maintain a balance with a centrifugal force of the support frame member.

In such an operation, generation of a reactive force in the entire cleaning system can be suppressed in the cleaning main body during the rotational motion of the cleaning main body.

The high-pressure water cleaning system may further comprise a cleaning chamber surrounding a cleaning area of the object; and first insertion openings provided on both end walls of the cleaning chamber, the coupling plates being respectively inserted into the first insertion openings. A surrounding region of each of the first insertion openings may be coupled to one of both opening peripheries of a bag-shaped bellows-like sealing member, and wherein a part of a periphery of the coupling plate protruding from each of the first insertion openings may be coupled to the other one of the both opening peripheries of the bag-shaped bellows-like sealing member.

In such a configuration, since the sealing members are deformed to absorb displacement of the coupling plate in the cleaning main body performing the rotational motion, the first insertion openings can be surely sealed.

The high-pressure water cleaning system may further comprise a cleaning chamber surrounding a cleaning area of the object; first insertion openings provided on both end walls of the cleaning chamber, the coupling plates being respectively inserted into the first insertion openings; sealing chambers which are respectively provided outside the first insertion openings, the sealing chambers being each configured to surround an associated first insertion opening and a part of an associated coupling plate protruding from the associated first insertion opening; second insertion openings respectively provided on side end walls of the sealing chambers, the coupling plates being each inserted into both of an associated one of the first insertion openings and an associated one of the second insertion openings; exhaust outlets respectively formed on upper walls of the sealing chambers; and a pair of sealing members which are in U-shape and in a leaf spring shape and are disposed in the vicinity of an associated one of the first insertion openings and an associated one of the second insertion openings within the sealing chamber, the sealing members being disposed such that one end of each of the sealing members is fixed to an inner wall of the sealing chamber and both side surfaces of the coupling plate are slidably in contact with open end portions of the sealing members.

In such a configuration, the sealing device is able to seal the first insertion opening although it has a more intricate structure than the above described sealing device.

The high-pressure water cleaning system may further comprise a cleaning chamber surrounding a cleaning area of the object; first insertion openings provided on both end walls of the cleaning chamber, the coupling plates being respectively inserted into the first insertion openings; and fixed-type sealing chambers having a double tube structure and having openings respectively connected to the first insertion openings in the longitudinal direction, the fixed-type sealing chambers each including an inner tube which opens at both ends thereof and an outer tube which opens at one end thereof and is configured to surround the inner tube to be spaced apart from the inner tube. The inner tube may be perforated to form a number of holes, and the outer tube may be perforated to form a plurality of holes. An open end portion of the outer tube may be connected to an end wall of the cleaning chamber such that the first insertion opening may be connected to an opening of the inner tube.

In such a configuration, the sealing members are movable, and hence tend to wear out and are unnecessary, and therefore a simpler structure is provided, as compared to the above described sealing device.

According to another aspect of the present invention, there is provided a high-pressure water cleaning system, having a cleaning main body, the cleaning system being configured to eject high-pressure water from the cleaning main body to both surfaces of an object to clean the object, while moving the object at a constant speed with respect to the cleaning main body, comprising a pair of support frame members each having a length which is larger than a width of the object, the support frame members being disposed in parallel with a center axis in a thickness direction of the cleaning main body interposed between the pair of support frame members; a plurality of high-pressure water ejecting nozzles which are arranged on opposite surfaces of the support frame members which are opposite to each other such that the ejecting nozzles are equally spaced apart from each other and the ejecting nozzles on the opposite surfaces are opposite to each other; and coupling plates integrally coupled to both end portions of each of the support frame members so as to extend laterally outward along the center axis in the width direction of the cleaning main body, the coupling plates being each eccentrically rotatably supported at an end portion thereof by a bearing unit and eccentric rotational shafts extending in a direction perpendicular to a surface of the coupling plate; a drive device configured to cause the eccentric rotational shafts to rotate to cause the support frame members to perform rotational motion; wherein the high-pressure water ejecting nozzles are supplied with the high-pressure water through a water passage extending along the support frame members and are configured to eject the high-pressure water to both surfaces of the object being moved at the constant speed while performing the rotational motion. In accordance with the high-pressure water cleaning system having such a configuration, the advantages achieved by the high-pressure water cleaning system of the first aspect can be achieved. In addition, since both surfaces of the object can be simultaneously cleaned, and the weight balance of upper and lower parts of the cleaning main body, which is defined by the center axis in the width direction thereof, is maintained, it is not necessary to attach the balance weights, and therefore the structure of the cleaning system can be simplified.

It is preferable that the high-pressure water cleaning system may further comprise a second drive device configured to cause the eccentric rotational shafts to rotate to cause the support frame members to perform rotational motion, and an eccentric rotation drive apparatus disposed outside a cleaning area of the object, and including at least one of the drive devices provided at an end portion of each of the coupling plates.

In such a configuration, since the eccentric rotation drive apparatus which tends to generate dust is disposed outside the cleaning area, the high-pressure water cleaning system can easily improve the cleanliness in the cleaning area.

Each of the high-pressure water ejecting nozzles may have a nozzle hole which is formed in a center position thereof to extend in a direction perpendicular to a tip end surface thereof. One end of a high-pressure water supply passage extending along the support frame members may be coupled to a base end side of the nozzle holes of the high-pressure water ejecting nozzles, and an opposite end of the high-pressure water supply passage may be coupled to a high-pressure water source via a flexible metal-made pipe.

The high-pressure water cleaning system may further comprise an eccentric rotation drive apparatus including the drive device provided at an end portion of each of the support frame members, a rotational shaft eccentric member which is configured to couple the eccentric rotational shafts in a position eccentric from a center axis of the rotational shaft eccentric member such that the rotational shafts are integrally rotatable with the rotational shaft eccentric member, and wherein the bearing units are bearing housing units respectively configured to rotatably support a rotational shaft eccentric member. The bearing housing unit may be integrally coupled to one end of the support frame member via the coupling plate.

The high-pressure water cleaning system may further comprise a second drive device configured to cause the eccentric rotational shafts to rotate to cause the support frame members to perform rotational motion, and an eccentric rotation drive apparatus including at least one of the drive devices provided at an end portion of each of the support frame members, a rotational shaft eccentric member which is configured to couple the upper shaft and the lower shaft of a corresponding one of the eccentric rotational shafts in a position eccentric from a center axis of the rotational shaft eccentric member such that the corresponding one of the rotational shafts is integrally rotatable with the rotational shaft eccentric member, and wherein each bearing unit includes a bearing housing unit configured to rotatably support a corresponding one of the rotational shaft eccentric members. Each bearing housing unit may be integrally coupled to one end of the support frame member via the coupling plate.

In such a configuration, since the eccentric rotation drive apparatus generates the eccentric rotational force at the extended end portions of the cleaning main body at both sides, the plurality of nozzles smoothly carry out the rotational motion simultaneously with the cleaning main body.

The rotational shaft eccentric member may be formed in a cylindrical shape. The upper shaft and the lower shaft of the corresponding one of the eccentric rotational shafts may be coupled to each other within a corresponding one of the bearing housing units in a position eccentric from the center axis of the cylindrical rotational shaft eccentric member such that the upper shaft and the lower shaft of the corresponding one of the eccentric rotational shafts are integrally rotatable with the rotational shaft eccentric member.

In such an operation, a relatively large eccentric amount is provided with respect to the center position of the cylindrical rotational shaft eccentric member. Further, since the rotational forces of the eccentric rotational shafts are transmitted to the rotational shaft eccentric member to cause the rotational shaft eccentric member to eccentrically rotate with the rotational shaft eccentric member rotatably supported by the bearing housing unit, the rotational shaft eccentric member smoothly rotates. As a result, the cleaning main body can perform the rotational motion.

The high-pressure water cleaning system may further comprise balance weights which are mounted to the upper shaft and the lower shaft of the corresponding one of the eccentric rotational shafts to be integrally rotatable with the corresponding one of the eccentric rotational shafts, and wherein the balance weights are mounted at upper and lower positions with the eccentric rotational shaft member, and wherein a corresponding one of the bearing housing units is interposed between the balance weights such that the balance weights are located on an opposite side of the center axis of the rotational shaft eccentric member with respect to a center axis of the corresponding one of the eccentric rotational shafts in an eccentric direction of the support frame member to maintain a balance with a centrifugal force of the support frame member.

In such an operation, generation of a reactive force in the entire cleaning system can be suppressed during the rotational motion of the cleaning main body.

The high-pressure water cleaning system may further comprise a cleaning chamber surrounding a cleaning area of the object; and first insertion openings respectively provided on both end walls of the cleaning chamber, the coupling plates being respectively inserted into the first insertion openings. A surrounding region of each of the first insertion openings may be coupled to one of both opening peripheries of a bag-shaped bellows-like sealing member, and a part of a periphery of the coupling plate protruding from each of the first insertion openings may be coupled to the other one of the both opening peripheries of the bag-shaped bellows-like sealing member.

In such a configuration, since the sealing members are deformed to absorb displacement of the coupling plate in the cleaning main body performing the rotational motion, the first insertion openings can be surely sealed.

The high-pressure water cleaning system may further comprise a cleaning chamber surrounding a cleaning area of the object; first insertion openings provided on both end walls of the cleaning chamber, the coupling plates being respectively inserted into the first insertion openings; sealing chambers which are respectively provided outside the first insertion openings, the sealing chambers being each configured to surround an associated one of the first insertion openings and a part of an associated one of the coupling plates protruding from the associated first insertion opening; second insertion openings respectively provided on side end walls of the sealing chambers, the coupling plates being each inserted into both of an associated one of the first insertion openings and an associated one of the second insertion openings; exhaust outlets respectively formed on upper walls of the sealing chambers; and a pair of sealing members which are in a U-shape and in a leaf spring shape and are disposed in the vicinity of an associated one of the first insertion openings and an associated one of the second insertion openings within the sealing chamber, the sealing members being disposed such that one end of each of the sealing members is fixed to an inner wall of the sealing chamber and both side surfaces of the coupling plate are slidably in contact with open end portions of the sealing members.

In such a configuration, the sealing member is deformed to absorb displacement of the coupling plate of the cleaning main body performing the eccentric rotational motion although the sealing device has a more intricate structure than the above described sealing device in the high-pressure water cleaning system of the first aspect.

The high-pressure water cleaning system may further comprise a cleaning chamber surrounding a cleaning area of the object; first insertion openings provided on both end walls of the cleaning chamber, the coupling plates being respectively inserted into the first insertion openings; and fixed-type sealing chambers having a double tube structure and having openings respectively connected to the first insertion openings in the longitudinal direction, the fixed-type sealing chambers each including an inner tube which opens at both ends thereof and an outer tube which opens at one end thereof and is configured to surround the inner tube to be spaced apart from the inner tube. The inner tube may be perforated to form a number of holes, and the outer tube may be perforated to form a plurality of holes. An open end portion of the outer tube may be connected to an end wall of the cleaning chamber such that the first insertion opening may be connected to the opening of the inner tube.

In such a configuration, the sealing members are movable, and hence tend to wear out are unnecessary, and a simpler structure is provided, as compared to the above described movable sealing device.

The above and further objects and features of the invention will more fully be apparent from the following detailed description with accompanying drawings.

DETAILED DESCRIPTION OF THE PREFERRED EMBODIMENTS

Hereinafter, preferred embodiments of the present invention will be described with reference to the accompanying drawings.

Embodiment 1

Figure 1:
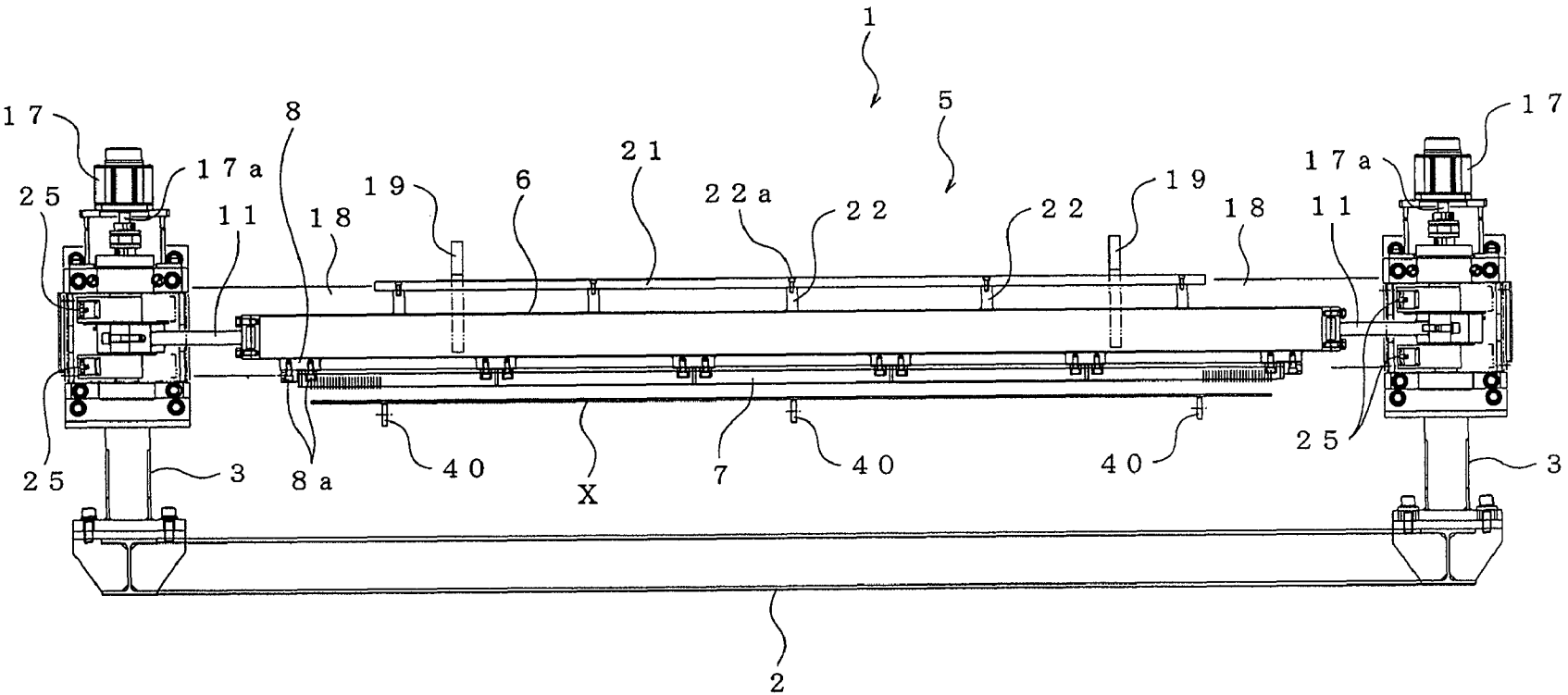
FIG. 1 is a front view of a high-pressure water cleaning system according to a first embodiment of the present invention, a part of which is illustrated in cross-section.
Figure 2:
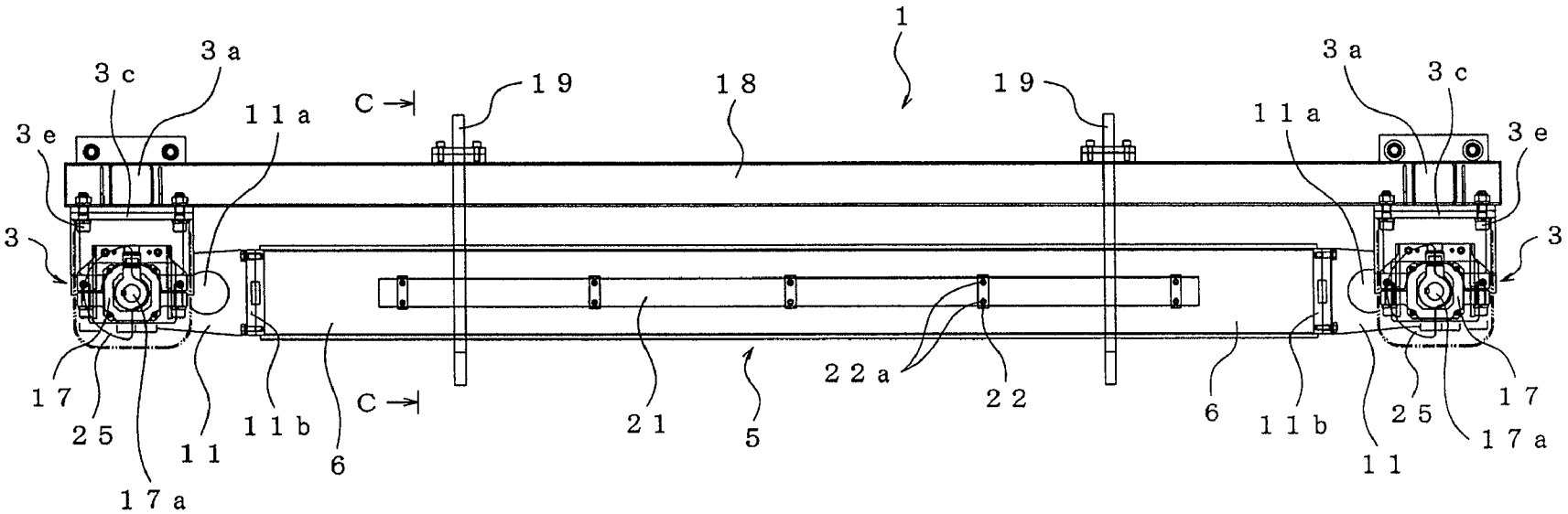
FIG. 2 is a plan view of the high-pressure water cleaning system according to the first embodiment of the present invention.
Figure 3:
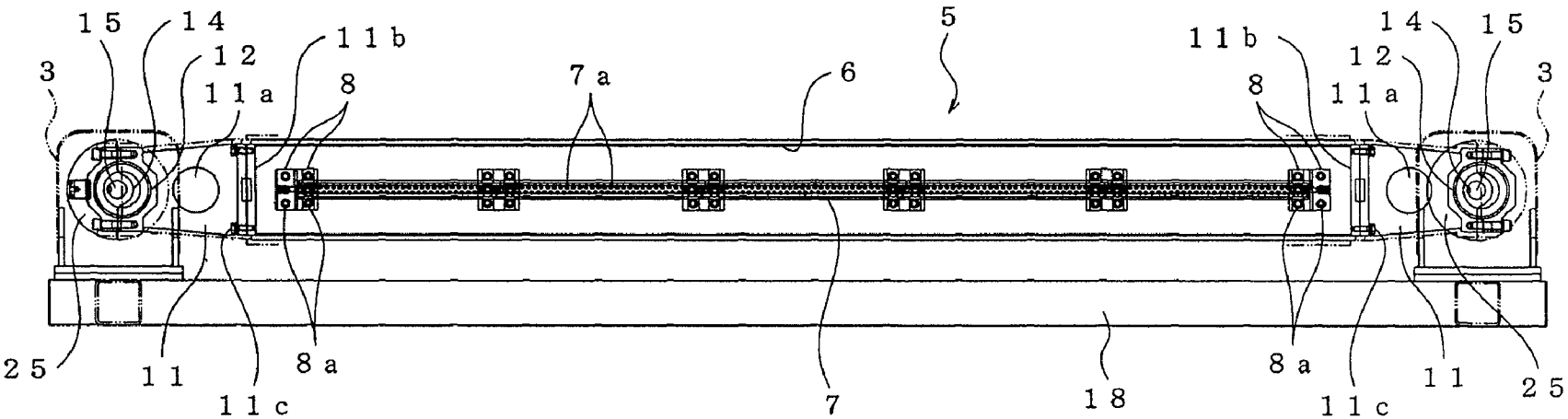
FIG. 3 is a bottom view of the high-pressure water cleaning system according to the first embodiment of the present invention.
Figure 4:
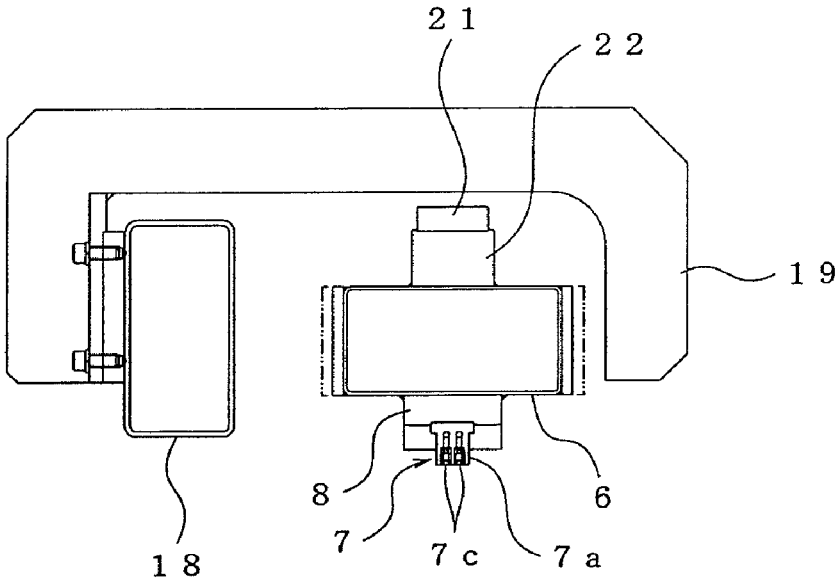
FIG. 4 is a cross sectional view taken along line C-C of FIG. 2.
Figure 5:
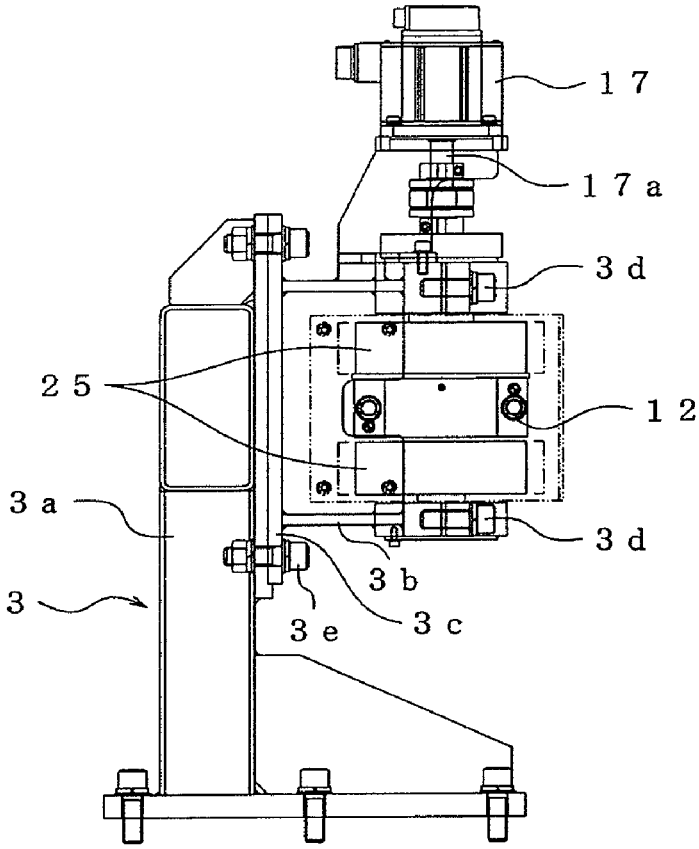
FIG. 5 is an enlarged left side view of the high-pressure water cleaning system of FIG. 1.

As shown in FIGS. 1 through 15, a high-pressure water cleaning system 1 includes support bases 3 at both sides of a frame member 2 extending below and across a cleaning chamber 30. Each support base 3 has a support column 3*a*. Upper portions of the support columns 3*a* located at both sides are coupled to each other by a cross beam 18. A cleaning main body 5 is rotatably mounted to front surfaces of upper portions of the support columns 3*a* by bolts 3*d* and 3*e* via support plates 3*c* and brackets 3*b* which are substantially in U-shape as viewed from the side. The cleaning main body 5 is supported by the support bases 3 located at both sides such that the cleaning main body 5 extends between the support bases 3. A pair of protecting frame members 19 are attached to the cross beam 18 so as to be spaced apart from each other in the longitudinal direction of the cross beam 18. As shown in FIG. 4, the protecting frame members 19 are downwardly recessed to surround the upper portion of the cleaning main body 5.

Figure 8:
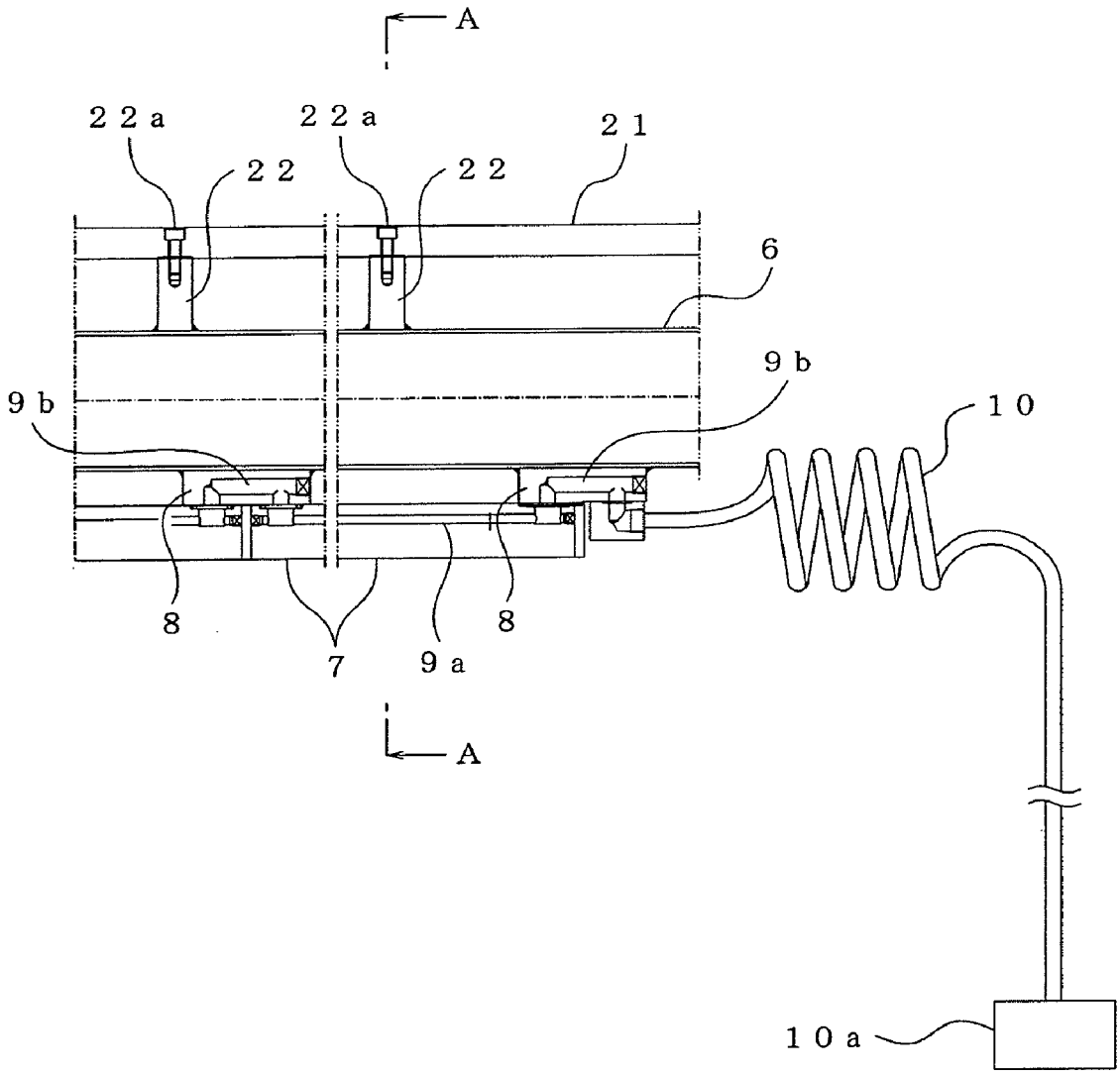
FIG. 8 is a central longitudinal sectional view showing an enlarged part of a cleaning main body.
Figure 9:
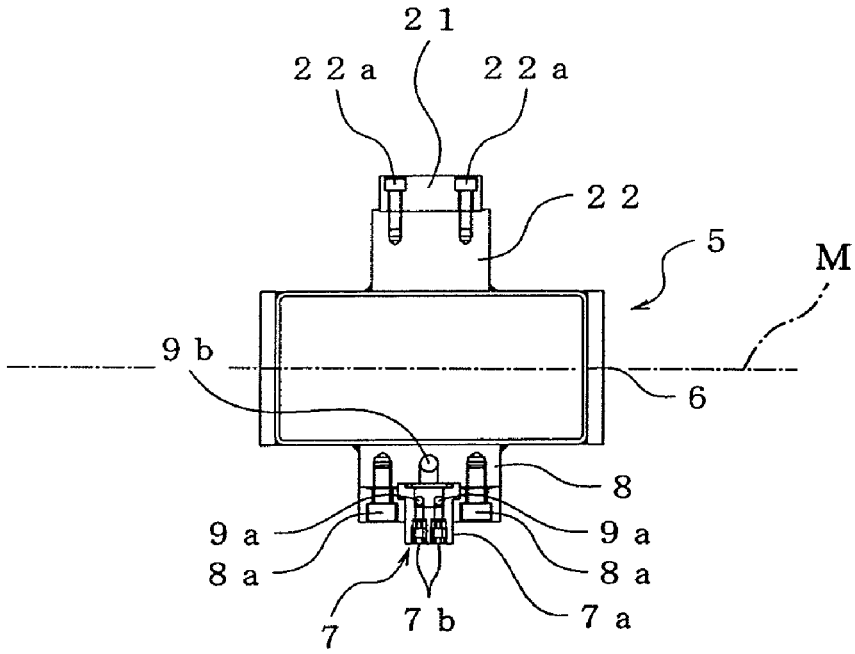
FIG. 9 is a cross-sectional view taken along line A-A of FIG. 8.
Figure 10:
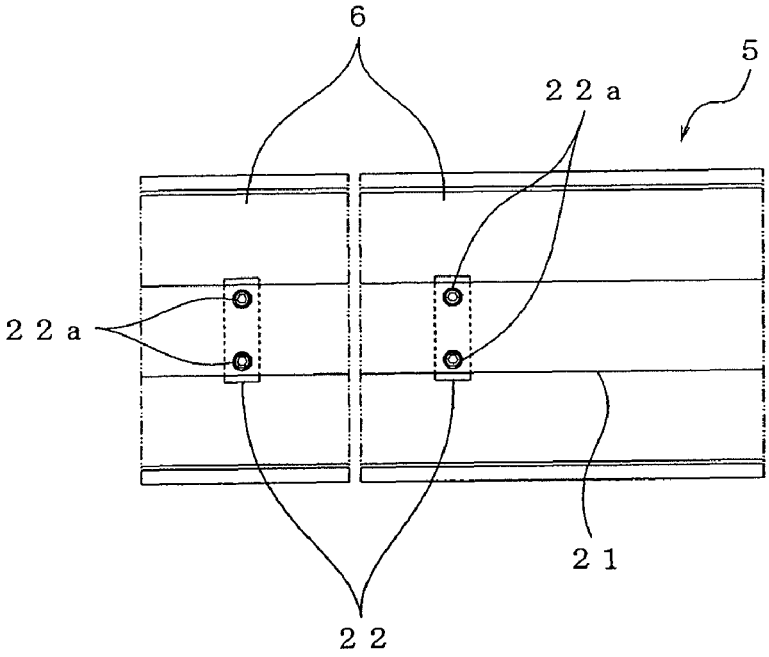
FIG. 10 is a plan view of the enlarged part of FIG. 8.
Figure 11:
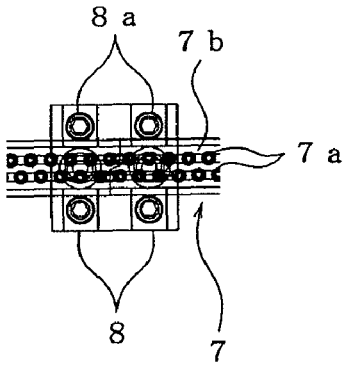
FIG. 11 is a bottom view of a nozzle head unit of FIG. 10.
Figure 12A:
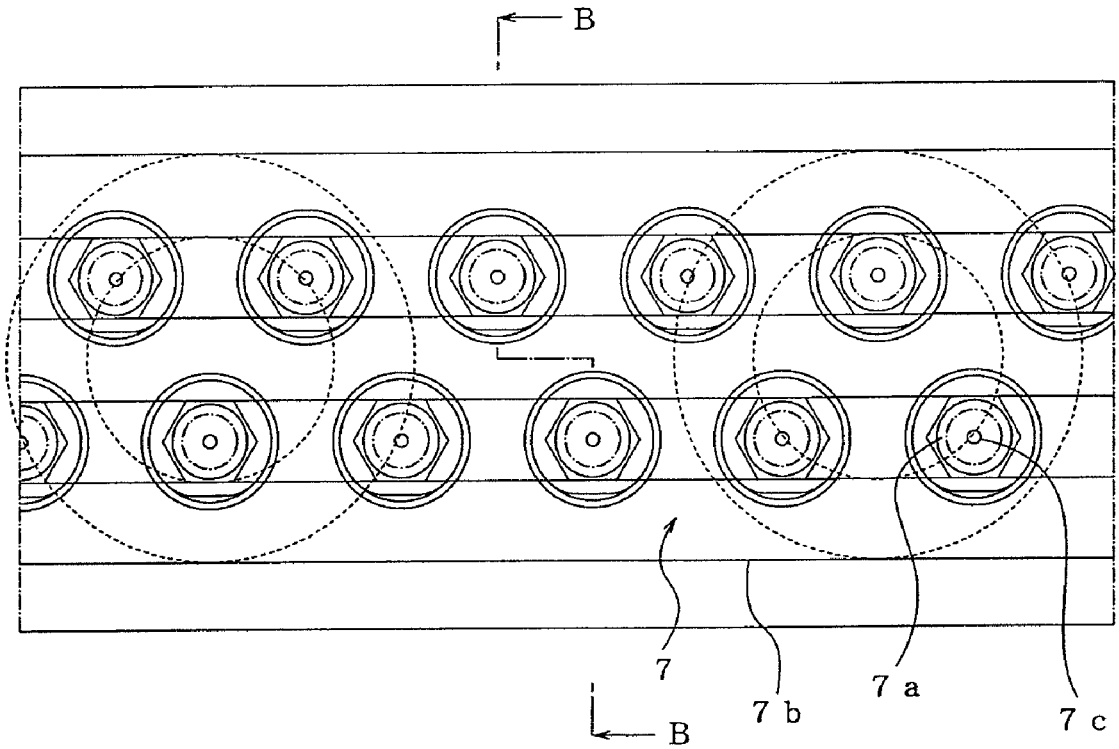
FIG. 12A is a bottom view showing an enlarged part of the nozzle head unit.
Figure 12B:
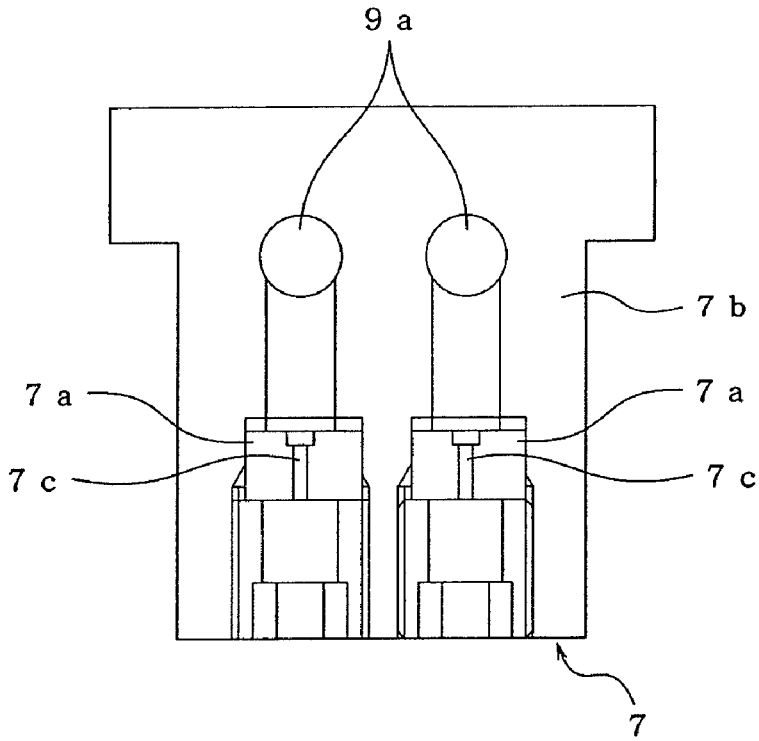
FIG. 12B is a longitudinal sectional view taken along line B-B of FIG. 12A.

As shown in FIG. 9, the cleaning main body 5 includes a hollow support frame member (hereinafter referred to as a hollow frame member) 6 which is formed by a tubular flat bar having a rectangular cross-section. Mounting brackets 8 protrude from a lower surface of the hollow frame member 6. Nozzle head units 7 are fastened to the mounting brackets 8 by bolts 8*a* to protrude downward. Each nozzle head unit 7 has a structure in which a number of high-pressure water ejecting nozzles 7*a* are arranged on a plate-shaped nozzle holder 7*b* in zigzag shape to be equally spaced apart from each other and to form two lines. As shown in FIGS. 8, 9, and 12, each nozzle 7*a* has a nozzle hole 7*c* which is located in a center position of a tip end (lower end) surface thereof and extends in a direction perpendicular to the tip end surface. The nozzle holder 7*b* and the nozzle head unit 7 are provided with high-pressure water supply passages 9*a* and 9*b* extending in the longitudinal direction thereof. As shown in FIG. 8, a metal-made pipe 10 extends from a high-pressure water tank 10*a* and is coupled to one end of the high-pressure water supply passage 9*b* in the nozzle holder 7*b*. The metal-made pipe 10 is flexible and formed in a spiral shape. The high-pressure water is supplied from the high-pressure water supply passage 9*b* to the nozzle holes 7*c* of the nozzles 7*a* through the high-pressure water supply passage 9*a* in the nozzle head unit 7. The high-pressure water is ejected in straight-line shape from the nozzle holes 7*a*. The metal-made pipe 10 need not be formed in spiral shape so long as it is flexible. For example, the metal-made pipe 10 may be entirely straight-line shaped or may be entirely curved.

In the present embodiment, an object X to be cleaned is a glass plate. The glass plate X is conveyed at a constant speed under the nozzle head units 7 by a conveyor device, for example, a roller conveyor 40. For this reason, the length of the nozzle head unit 7 is set slightly longer than the width of the glass plate X so that the glass plate X is entirely cleaned. The length of the hollow frame member 6 to which the nozzle head unit 7 is mounted is set slightly larger than the length of the nozzle head unit 7.

Mounting plates 11*b* are respectively fastened to the coupling plates 11, at one end of each coupling plate, and are integrally coupled to both ends of the hollow frame member 6 by bolts 11*c*. For the purpose of lightweight, each coupling plate 11 has a circular opening 11*a* penetrating therethrough in a thickness direction thereof. A ring-shaped bearing housing (e.g., bearing unit) 12 is integrally formed at an opposite end (outer end) of each coupling plate 11. A cylindrical rotational shaft eccentric member 14 is rotatably mounted by a bearing 13 within each bearing housing 12. Upper and lower rotational shafts (eccentric rotational shafts) 15 are respectively rotatably supported by upper and lower portions of the rotational shaft eccentric member 14 within the bearing housing 12. The upper and lower rotational shafts 15 are coupled to each other in a position which is, for example, a value in a range of several mm to about fifteen mm, eccentric in one direction (to the left in FIG. 6) from a center axis S1' of the rotational shaft eccentric member 14 such that the rotational shafts 15 are integrally rotatable with the rotational shaft eccentric member 14. Servo motors 17 are mounted to the upper end surfaces of the right and left support bases 3, respectively. The upper ends of the rotational shafts 15 are respectively coupled to drive shafts 17*a* of the servo motors 17, respectively.

Figure 6A:
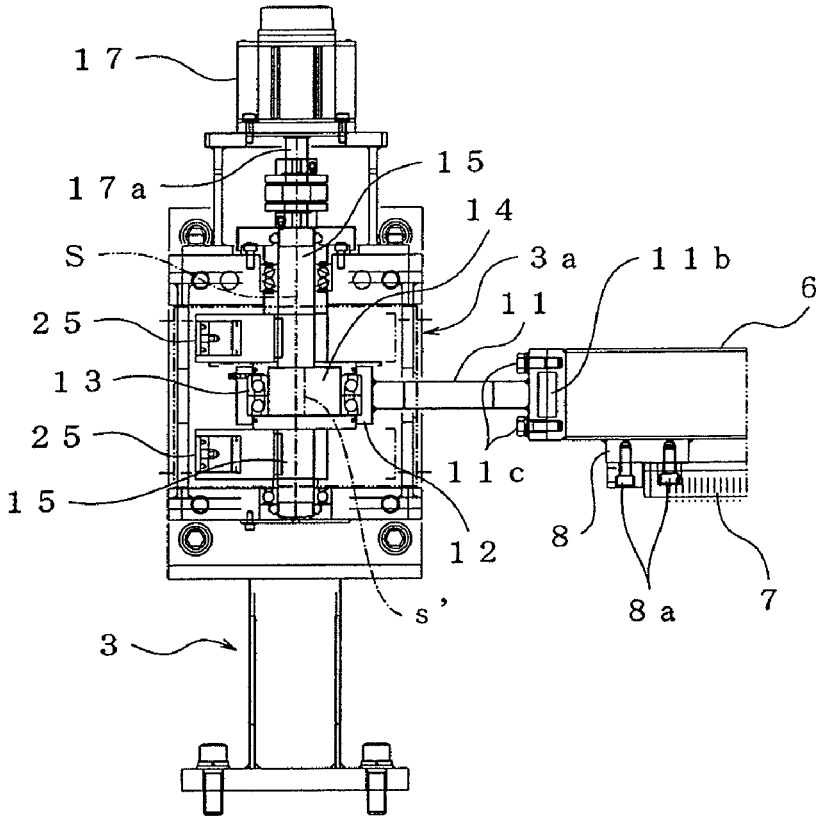
FIG. 6A is a front view showing a portion surrounding a support base on the left side in FIG. 1.
Figure 6B:
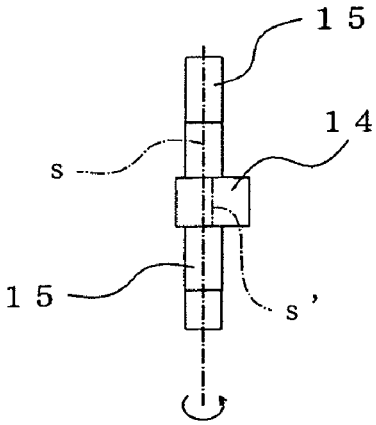
FIG. 6B is a view schematically showing a rotational shaft eccentric member and upper and lower rotational shafts.
Figure 6C:
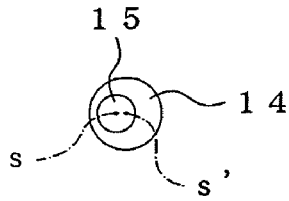
FIG. 6C is a plan view of the rotational eccentric member and the rotational shafts shown in FIG. 6B.
Figure 7:
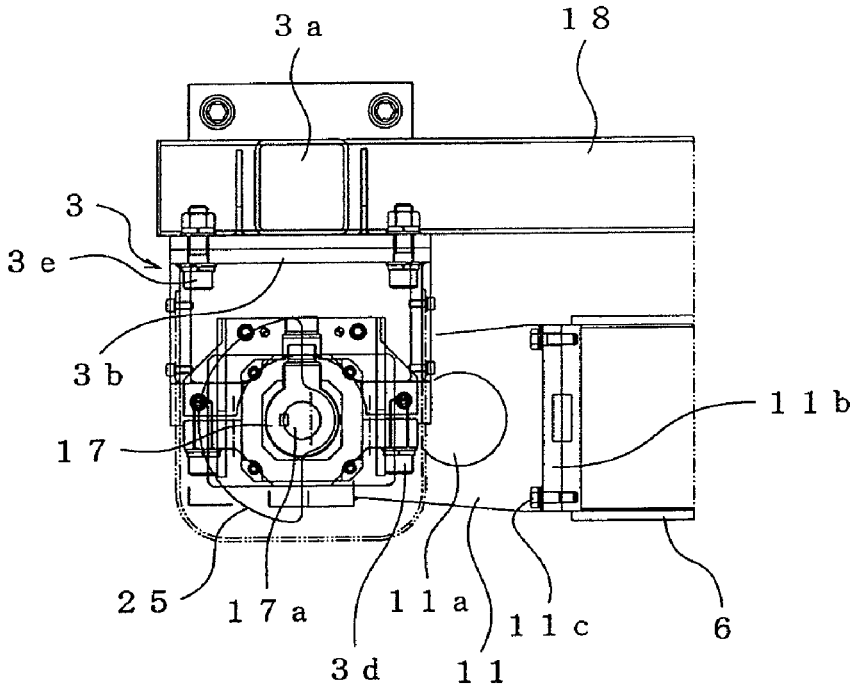
FIG. 7 is a plan view of the portion shown in FIG. 6A.
Figure 23A:
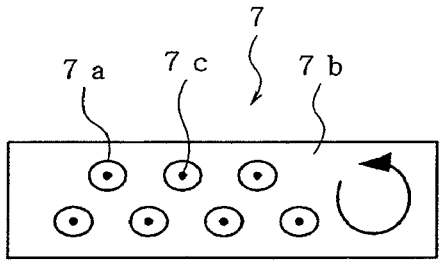
FIG. 23A is a bottom view of a nozzle head unit, showing its rotational motion.
Figure 23B:
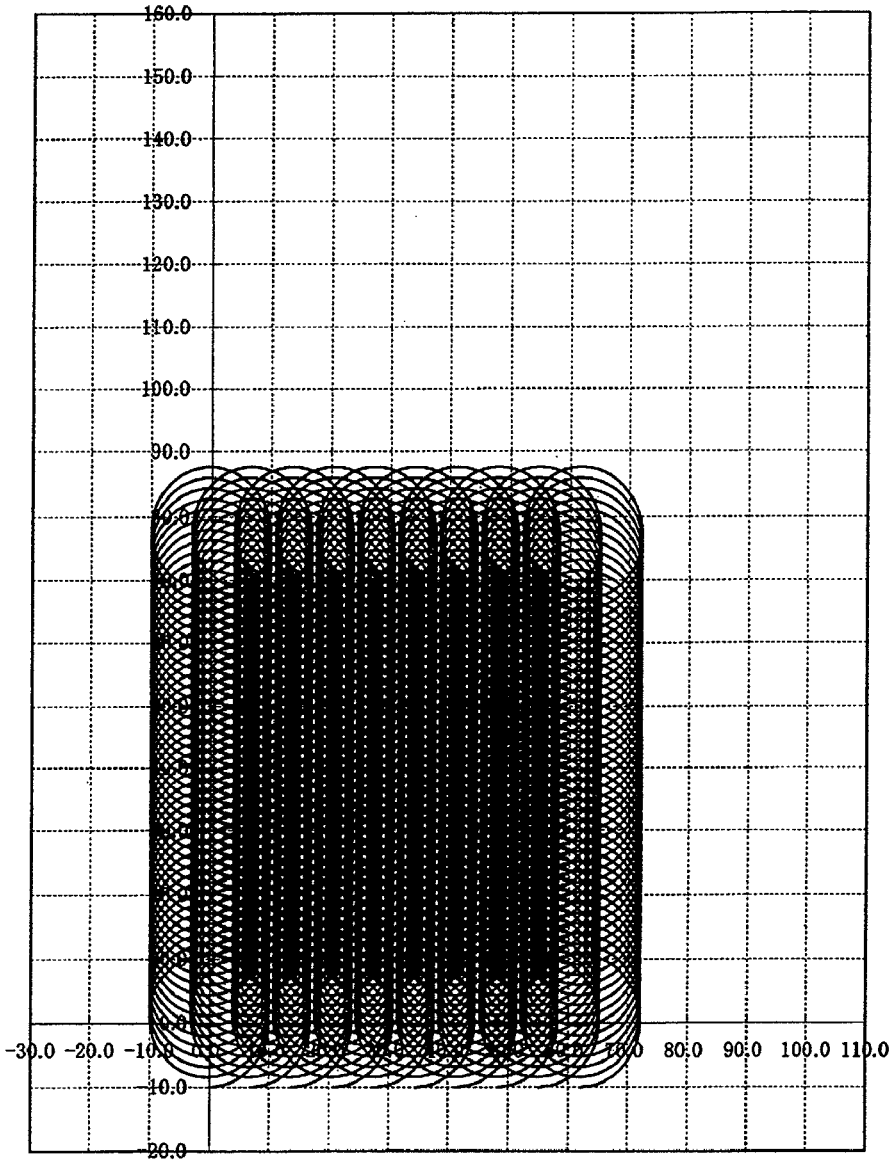
FIG. 23B is a view showing a trajectory of cleaning water ejected from the nozzle head unit of FIG. 23A.
Figure 24:
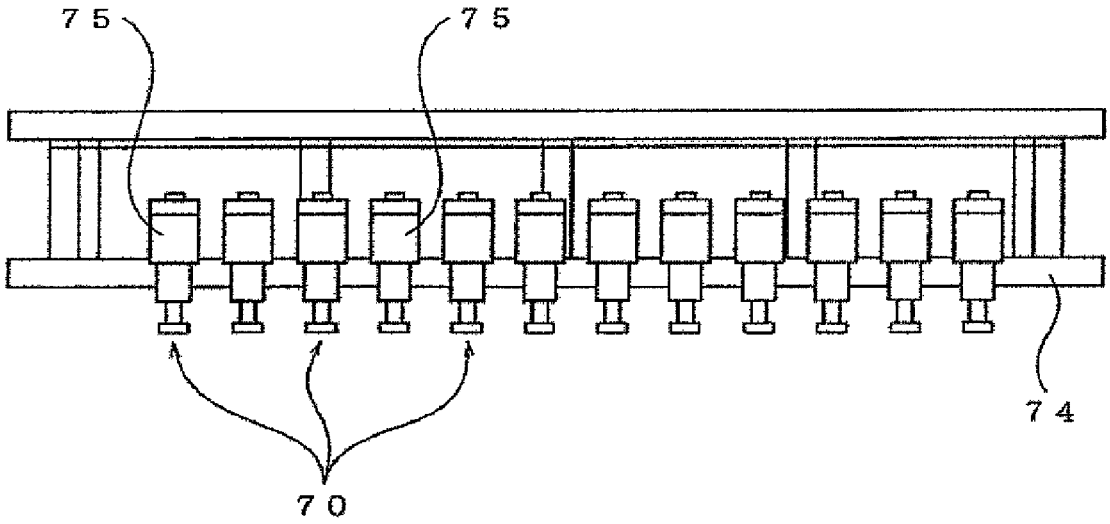
Fig. 24 PRIOR ART
FIG. 24 is a front view of the conventional high-pressure water cleaning system.
Figure 25A:
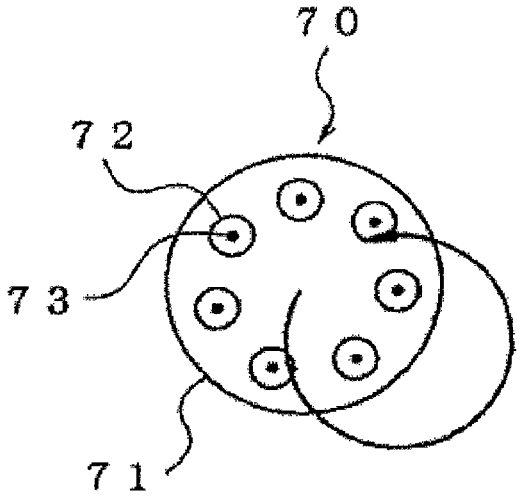
Fig. 25A PRIOR ART
FIG. 25A is a bottom view of a nozzle head unit of the conventional high-pressure water cleaning system, showing its rotational motion.
Figure 25B:
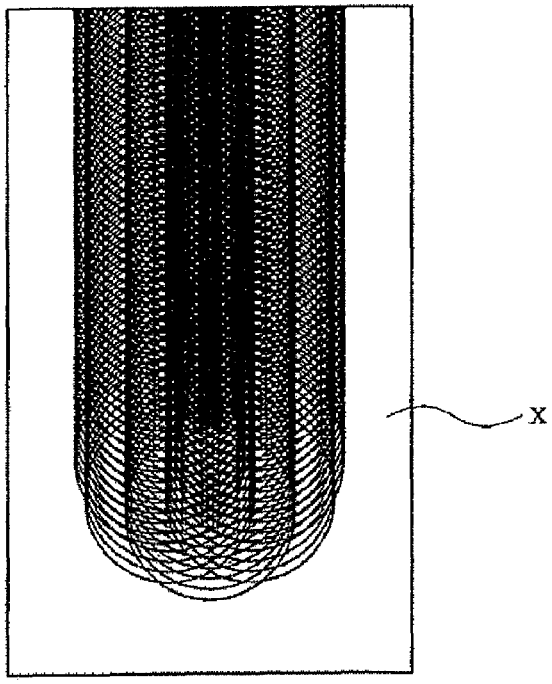
Fig. 25B PRIOR ART
FIG. 25B is a view showing a cleaning trajectory performed by one nozzle head unit of FIG. 25A.

Thereby, the right and left servo motors 17 are rotated substantially in synchronization with each other, and the eccentric rotational shafts 15 are rotated such that the center axis S is eccentric from the center axis S' of the rotational shaft eccentric member 14 as shown in FIGS. 6B and 6C. As a result, the hollow frame member 6 performs eccentric rotational motion, and at the same time, the nozzle head units 7 perform rotational motion (pivot movement). That is, when the rotational shafts 15 are rotated, the cylindrical rotational shaft eccentric member 14 is rotated eccentrically, causing the cleaning main body 5 (e.g., hollow frame member 6 and the nozzle head unit 7) to perform rotational motion via the bearing housing unit 12 (including the bearing 13). Such an operation is similar to that occurring in a crank system. In a case where the servo motor 17 which is the drive device is mounted to only one of the support bases 3 and an attempt is made to start rotating the rotational shafts 15 on one side, the cleaning main body 5 cannot in some cases perform the rotational motion, depending on the stopped state of the cleaning main body 5. This may not happen in the present embodiment, since the right and left servo motors 17 are provided to transmit the driving force to the rotational shafts 15 substantially at the same time. Upon the driving force being transmitted to the rotational shafts 15, the high-pressure water is ejected in a straight-line shape from the nozzle holes 7*c* of the nozzles 7*a*, generating a trajectory of the high-pressure water on the surface of the object X as shown in FIG. 23B. Thus, the object X is cleaned. As shown in FIG. 23A, in the present embodiment, the nozzles 7*a* are arranged in zigzag shape to be equally spaced apart from each other and to form two lines so that the entire surface of the object X is uniformly cleaned. In addition, each nozzle 7*a* is provided with one nozzle hole 7*c* which is located in the center position of the tip end surface thereof and extends in the direction perpendicular to the tip end surface. In this state, each nozzle 7*a* ejects high-pressure cleaning liquid (e.g., super natural water or chemical solution) in straight-line shape from the nozzle holes 7*c* while rotating to draw a perfect circle. As a result, the cleaning water draws a trajectory as shown in FIG. 23B. Thus, a cleaning operation which does not result in non-uniformity in cleaning strength is achieved. The cleaning conditions are set to optimal conditions depending on the kind of object X. For example, the ejecting pressure of the cleaning liquid and the rotational speed of the nozzle head units 7 are adjustable.

Since the cleaning main body 5 (including the nozzle head unit 7 and the hollow frame member 6) performs the rotational motion (e.g., pivot movement) so as to draw the perfect circle in the high-pressure water cleaning system 1, it is essential that the entire high-pressure water cleaning system 1 be well-balanced, i.e., a balance of the cleaning main body 5 including the hollow frame member 6, and a balance between the cleaning main body 5 including the hollow frame member 6 and the support bases 3 during the rotational motion of the cleaning main body 5, be maintained. If the balance is not well maintained, a vibration may be generated in the entire high-pressure water cleaning system 1, causing the cleaning operation to be disordered. To avoid such a situation, in the present embodiment, a counterweight 21 of a flat bar shape is mounted by bolts 22*a* to a plurality of brackets 22 protruding from the upper surface of the hollow frame member 6 to be spaced apart from the upper surface of the support frame member 6 to maintain a balance of a weight and a moment between an upper part and a lower part including the nozzle units 7 (and the high-pressure water supply passages 9*a* and 9*b*), which are located at opposite sides with respect to a center axis M extending at a center in the thickness direction of the hollow frame member 6. As a result, an undesired moment is not generated in the cleaning main body 5 (including the hollow frame member 6) and each nozzle 7*a* is able to smoothly rotate so as to draw the perfect circle during the rotational motion of the cleaning main body 5 (including the hollow frame member 6).

Upper and lower counterweights 25 of a semicircular plate shape are integrally mounted to the upper and lower rotational shafts 15, respectively, such that the counter weights 25 are rotatable together with the rotational shafts 15 with the rotational shaft eccentric member 14 interposed therebetween, to cancel a moment generated during the rotational motion of the cleaning main body 5. The counter weights 25 are disposed in an opposite position in the rotation direction of the cleaning main body 5 with respect to the center axis S of the rotational shafts 15, i.e., in a position opposite the position of center axis S' of the rotational shaft eccentric member 14 with respect to the center axis S of the rotational shaft 15. The counter weights 25 for the right and left rotational shafts 15 are directed to face in the same direction. As a result, during the rotation of the rotational shafts 15, the counterweights 25 are displaced to the position opposite to the rotation direction of the cleaning main body 5, i.e., in the position opposite to center axis S' of the rotational shaft eccentric member 14 with respect to the center axis S, to cancel the moment which is about to be generated during the rotational motion of the cleaning main body 5. Therefore, an undesired moment and hence a vibration are not generated in the high-pressure water cleaning system 1, including the support bases 3 at both sides.

Figure 13A:
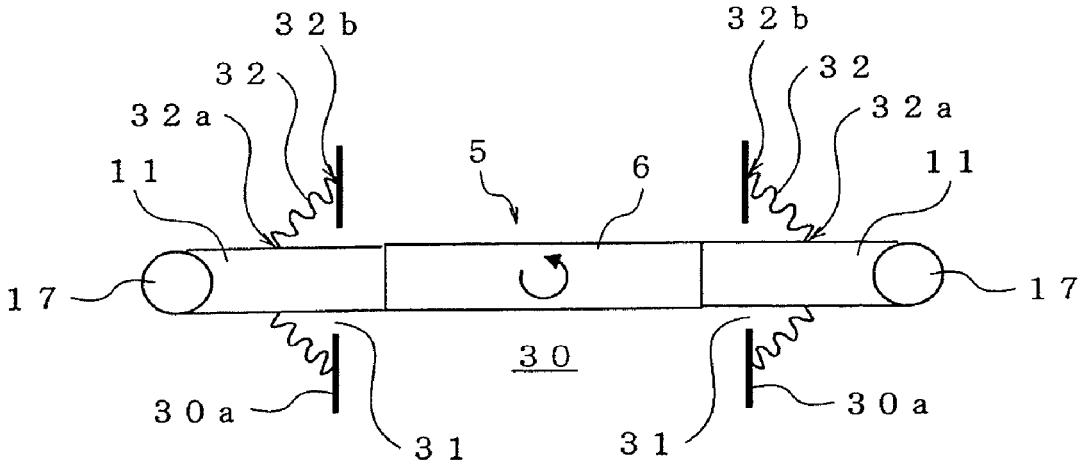
FIG. 13A is a cross-sectional view schematically showing sealing devices at insertion openings of extended parts (e.g., coupling plates) of a hollow frame member, which are provided at both side walls forming a cleaning chamber, as viewed from above.
Figure 13B:
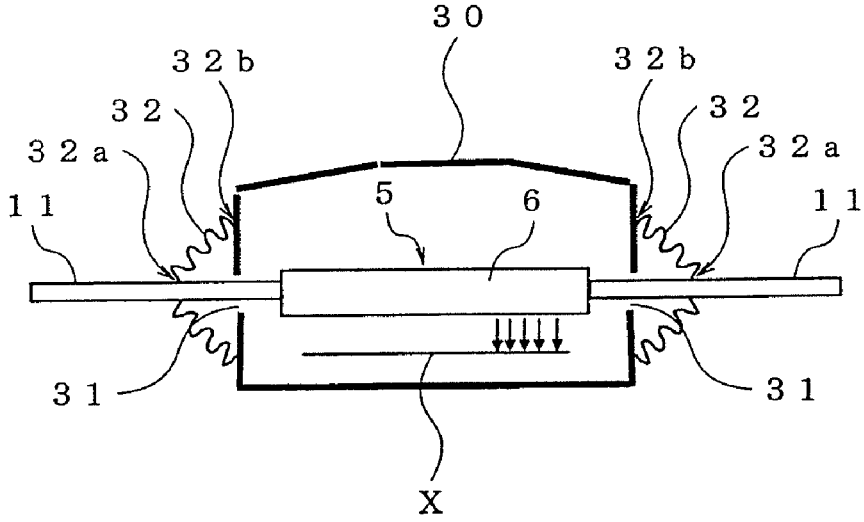
FIG. 13B is a cross-sectional view schematically showing the sealing devices of FIG. 13A, as viewed from the side.

FIG. 13A is a cross-sectional view schematically showing sealing devices at insertion openings of extended parts (e.g., coupling plates) of a hollow frame member 6, which are provided at both side walls forming a cleaning chamber, as viewed from above, and FIG. 13B is a cross-sectional view schematically showing the sealing devices of FIG. 13A, as viewed from the side.

As shown in FIGS. 13A and 13B, first insertion openings 31 are formed on both side walls 30*a* of the cleaning chamber 30 surrounding the cleaning area. The first insertion openings 31 have a rectangular shape so as to conform to a cross-section of the coupling plates 11 coupled to the hollow frame member 6. Since the coupling plates 11 are rotatable eccentrically integrally with the hollow frame member 6, a gap of $\alpha$ (e.g., 12 mm) is provided on one side as viewed from above between the first insertion opening 31 and the coupling plate 11 in the width direction of the coupling plate 11, and a gap which is approximately several mm is provided on one side in a side view between the first insertion opening 31 and the coupling plate 11 in the thickness direction of the coupling plate 11. To inhibit entry of foreign matters such as dust through the gaps, a bag-shaped bellows-like sealing member 32 is disposed in such a manner that one edge 32*a* thereof is attached to surround the periphery of the coupling plate 11 and an opposite edge 32*b* thereof is located to extend in a surrounding region of the insertion opening 31.

Figure 14A:
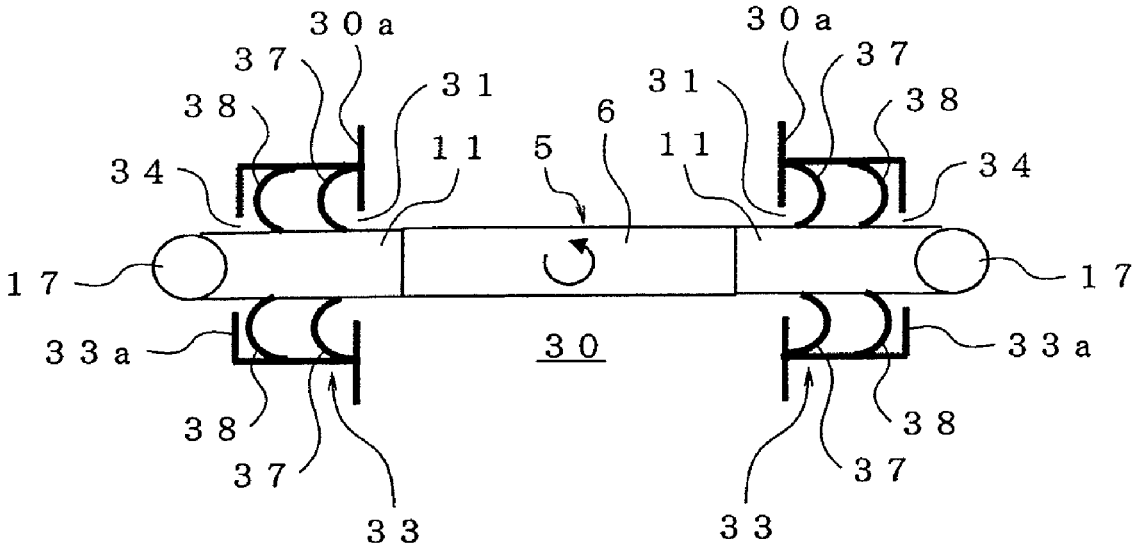
FIG. 14A is a cross-sectional view schematically showing another structure of sealing devices at insertion openings of extended parts (e.g., coupling plates) of the hollow frame member, which are provided at both side walls forming the cleaning chamber, as viewed from above.
Figure 14B:
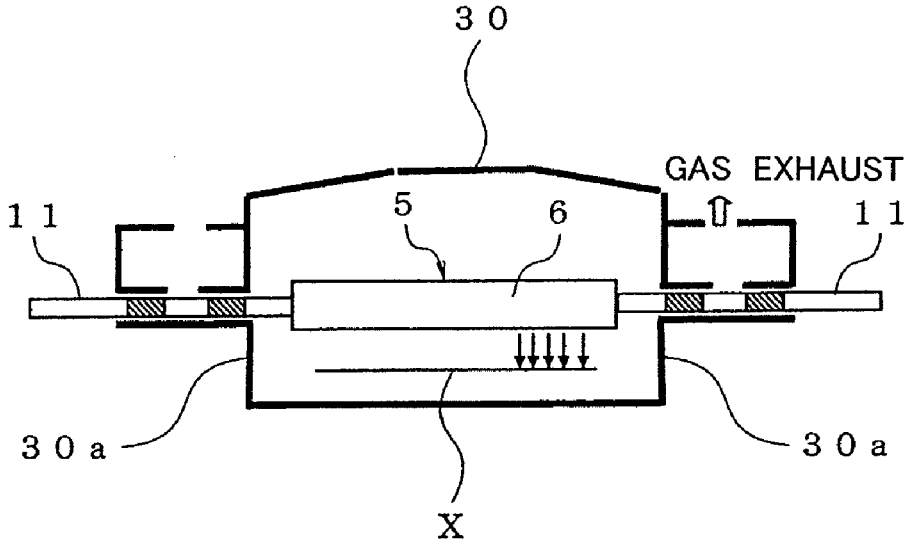
FIG. 14B is a cross-sectional view schematically showing the sealing devices of FIG. 14A, as viewed from the side.

FIG. 14A is a cross-sectional view schematically showing another structure of sealing devices at insertion openings of extended parts (e.g., coupling plates) of the hollow frame member, which are provided at both side walls forming the cleaning chamber, as viewed from above. FIG. 14B is a cross-sectional view schematically showing the sealing devices of FIG. 14A, as viewed from the side.

Figure 15:
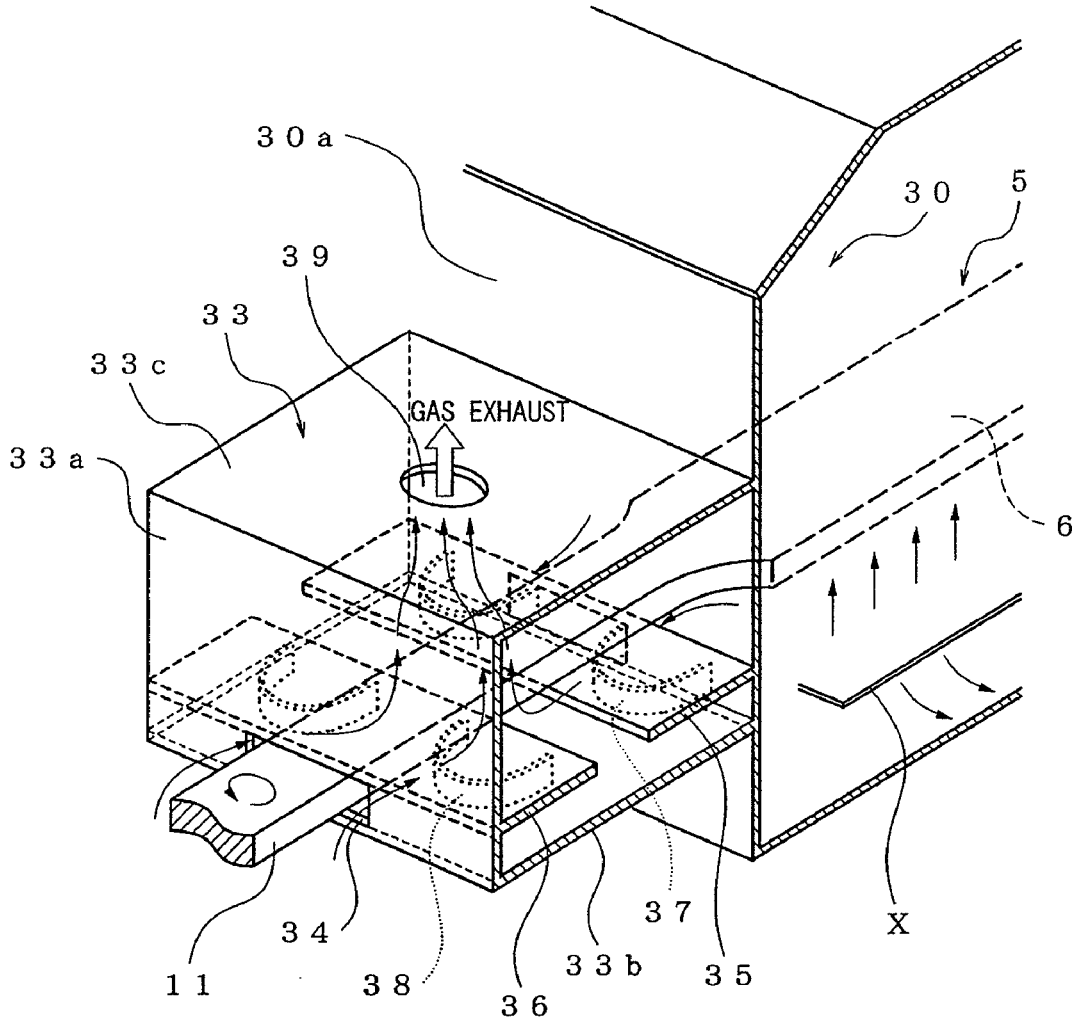
FIG. 15 is a perspective view showing the sealing device provided at one of the insertion openings in FIGS. 14A and 14B, which is illustrated as being partly in cross-section.

As shown in FIGS. 14A and 14B, and FIG. 15, first insertion openings 31 are formed on both side walls 30*a* of the cleaning chamber 30. The insertion openings 31 have a rectangular shape so as to conform to a cross-section of the coupling plates 11 coupled to the hollow frame member 6. In the present embodiment, box-like sealing chambers 33 are formed integrally with both side walls 30*a* of the cleaning chamber 30 to surround the first insertion openings 31. In addition, second insertion openings 34 having a shape identical to that of the first insertion openings 31 are formed on end walls 33*a* of the sealing chambers 33. As shown in FIG. 15, within each sealing chamber 33, a bottom plate 33*b* is disposed in the vicinity of lower edges of the first insertion opening 31 and the second insertion opening 34, and retaining plates 35 and 36 having a predetermined width are inwardly fixed to extend along upper edges of the first and second insertion openings 31 and 34. A pair of sealing members 37 which are in U-shape and in a leaf spring shape are disposed in a space formed between the retaining plate 35 and the bottom plate 33*b* in the vicinity of the insertion opening 31. The sealing members 37 are disposed such that both surfaces of the coupling plate 11 are slidably in contact with open end portions of the sealing members 37 and opposite end portions of the sealing members 37 are fixed to the bottom plate 33*b* and the retaining plate 35. In addition, a pair of sealing members 38 which are in U-shape and in a leaf spring shape are disposed in a space formed between the retaining plate 36 and the bottom plate 33*b* in the vicinity of the second insertion opening 34. The sealing members 38 are disposed such that both surfaces of the coupling plate 11 are slidably in contact with open end portions of the sealing members 38 and the opposite end portions of the sealing chambers 38 are fixed to the bottom plate 33*b* and the retaining plate 36. Furthermore, an exhaust outlet 39 opens at a substantially center position of a top plate 33*c* of the sealing chamber 33. The pressure in the interior of the sealing chamber 33 is set slightly lower than the pressure in the interior of the cleaning chamber 30 so that air flows from the cleaning chamber 30 into the sealing chamber 33.

With the open end portions of the sealing members 37 and 38 in contact with both side surfaces of the coupling plate 11, the sealing members 37 and 38 seal both side surfaces of the coupling plate 11 while being elastically deformed according to the rotational motion of the cleaning main body 5. Since the retaining plates 35 and 36 are provided in close proximity to the upper and lower surfaces of the coupling plate 11, a gap is not substantially formed between them. Clean air is always introduced into the cleaning chamber 30, flows into the sealing chamber 33 from the first insertion opening 31 and through the gap between the first insertion opening 31 and the coupling plate 11, and is exhausted through the exhaust outlet 39. Because of the air flow, outside air is suctioned from the second insertion opening 34 into the sealing chamber 33 through the gap between the second insertion opening 34 and the coupling plate 11, and is exhausted through the exhaust outlet 39. Thereby, the first insertion opening 31 of the cleaning chamber 30 is disconnected from outside (i.e., from second insertion opening 34), so that air tightness within the cleaning chamber 30 is maintained.

Figure 16A:
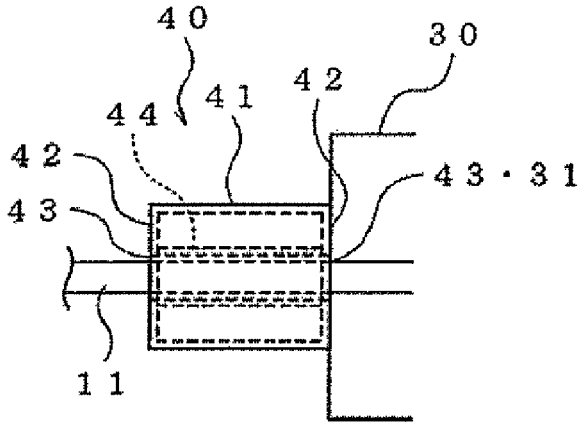
FIG. 16A is a side view schematically showing another structure of sealing devices at insertion openings of extended parts (e.g., coupling plates) of the hollow frame member, which are provided at both side walls forming the cleaning chamber, as viewed from above.
Figure 16B:
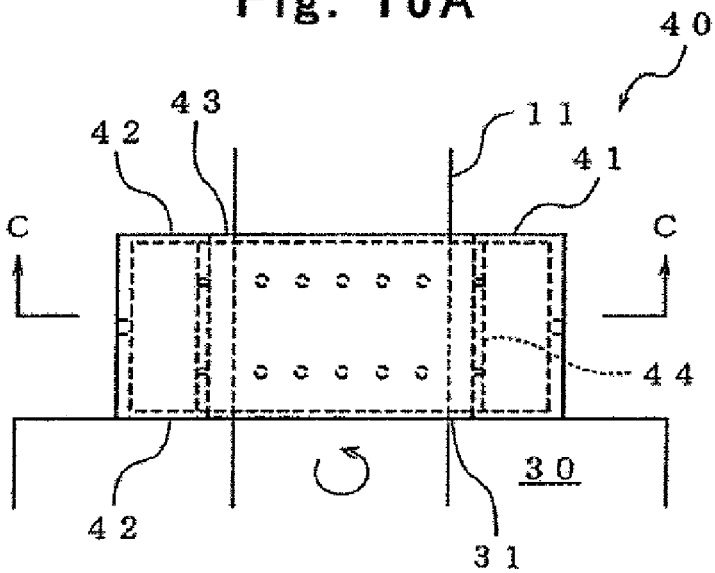
FIG. 16B is a plan view schematically showing the sealing devices of FIG. 16A.
Figure 16C:
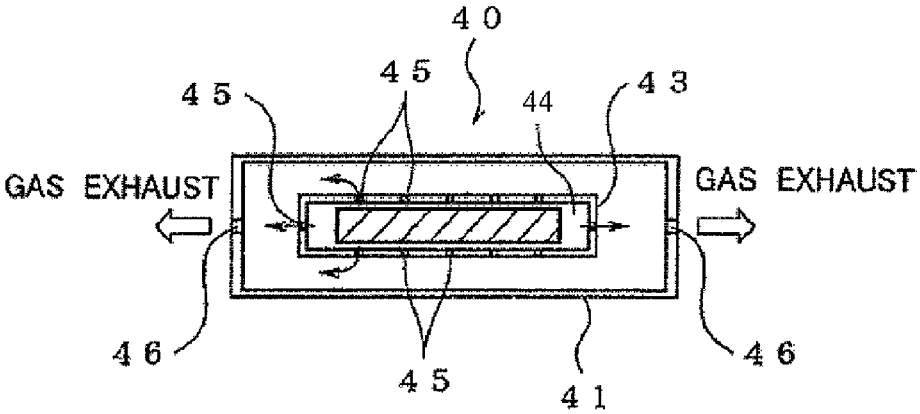
FIG. 16C is a cross-sectional view taken along line C-C of FIG. 16B.

FIG. 16A is a cross-sectional view schematically showing another structure of sealing devices at insertion openings of extended parts (e.g., coupling plates) of the hollow frame member, which are provided at both side walls forming the cleaning chamber, as viewed from above. FIG. 16B is a plan view schematically showing the sealing devices of FIG. 16A. FIG. 16C is a cross-sectional view taken along line C-C of FIG. 16B.

As shown in FIGS. 16A, 16B, and 16C, another structure of the sealing devices will be described. The sealing device of the present embodiment is of a fixed type and does not include the movable or flexible sealing members. Sealing chambers 40 of a double tubular shape having a rectangular cross-section are connected to the both side walls 30*a* of the cleaning chamber 30 so as to surround the first insertion openings 31, respectively. Each sealing chamber 40 has an insertion opening 43 connected to the insertion opening 31 of the cleaning chamber 30 in the longitudinal direction thereof and has an elongated shape identical to that of the insertion opening 31. The sealing chamber 40 includes an inner tube 44 which opens at both ends thereof and an outer tube 41, which surrounds the entire periphery of the inner tube 44 with a specified gap between the inner tube 44 and the outer tube 41 and which has an open end. The opening cross-section of the inner tube 44 including both open ends has a shape identical to that of insertion opening 43. As shown in FIGS. 16B and 16C, a plurality of exhaust outlets 45 are formed on upper and lower surfaces and side surfaces of the inner tube 44, and exhaust outlets 46 are formed on side walls of the outer tube 41. The insertion opening 43 of the inner tube 44 is identical to the first insertion opening 31. As shown in FIG. 16C, the insertion opening 43 of the inner tube 44 is sized to allow the rotational motion of the coupling plate 11. The pressurized air flows out from inside the cleaning chamber 30 through the exhaust outlets 45 and 46 and entry of air from outside into the cleaning chamber 30 is inhibited. Therefore, the first insertion opening 31 of the cleaning chamber 30 is disconnected from the outside (e.g., outside opening of the inner tube 44), so that air tightness within the cleaning chamber 40 is maintained. The sealing device of the present embodiment does not include the sealing members which are movable and hence tend to wear out, unlike the sealing devices of FIGS. 14A and 14B and 15A and 15B. In FIG. 16, reference number 42 denotes an end wall of one end (e.g., the outer end) of the outer tube 41.

Subsequently, how the high-pressure water cleaning system, configured as described above of the first embodiment, carries out the cleaning operation will be described with reference to FIGS. 1 through 15.

Here it is assumed that the object X is a glass plate. The object X is carried into the cleaning chamber 30 and is put on the roller conveyor 40. The object X is conveyed at a constant speed to under the cleaning main body 5. Prior to start of conveying the object X, clean air is introduced into the cleaning chamber 30 so that a clean atmosphere is maintained. Then, the right and left servo motors 17 start driving to cause the rotational shaft 15 to rotate. Thereby, the cylindrical rotational shaft eccentric member 14 rotates eccentrically, causing the cleaning main body 5 to perform the rotational motion via the bearing housing unit 12. Then, the high-pressure cleaning liquid is supplied from the high-pressure water tank 10*a* (see FIG. 8) to the nozzles 7*a* through the flexible metal-made pipe 10 and the high-pressure water supply passage 9*b*, and the high-pressure water supply passage 9*a*. Each nozzle 7*a* rotates to draw the perfect circle to eject the high-pressure water in the straight-line shape from the associated nozzle hole 7*c*. In this state, the glass substrate X is conveyed at a constant speed by the roller conveyor 40 to under the cleaning main body 5. The high-pressure cleaning liquid is ejected from all the nozzles 7*a* to one surface of the glass substrate X and draws the cleaning trajectory shown in FIG. 23B. Thus, the cleaning operation is carried out without non-uniformity in cleaning strength.

FIGS. 17 to 22 show a high-pressure water cleaning system 1' according to a second embodiment of the present invention.

As can be seen from FIGS. 17 to 22, the high-pressure water cleaning system 1' of the second embodiment is different from the high-pressure water cleaning system 1 of the first embodiment as follows.

Whereas the high-pressure water cleaning system 1 is configured to clean one surface (e.g., an upper surface) of the object X, the high-pressure water cleaning system 1' of the present embodiment is configured to clean both surfaces of the object X. To this end, a pair of hollow support frame members 6 forming a cleaning main body 5' are disposed to extend in parallel to be spaced apart at upper and lower positions such that the support frame members 6 are opposite to each other. Each hollow frame member 6 has a tubular shape with a rectangular cross-section. Plate-shaped coupling members 51 couple the right end portions of the upper and lower support frame members 6 and the left end portions of the upper and lower support frame members 6. The coupling plate 11 extends outward from an intermediate position in the vertical direction of each coupling member 51.

Figure 17:
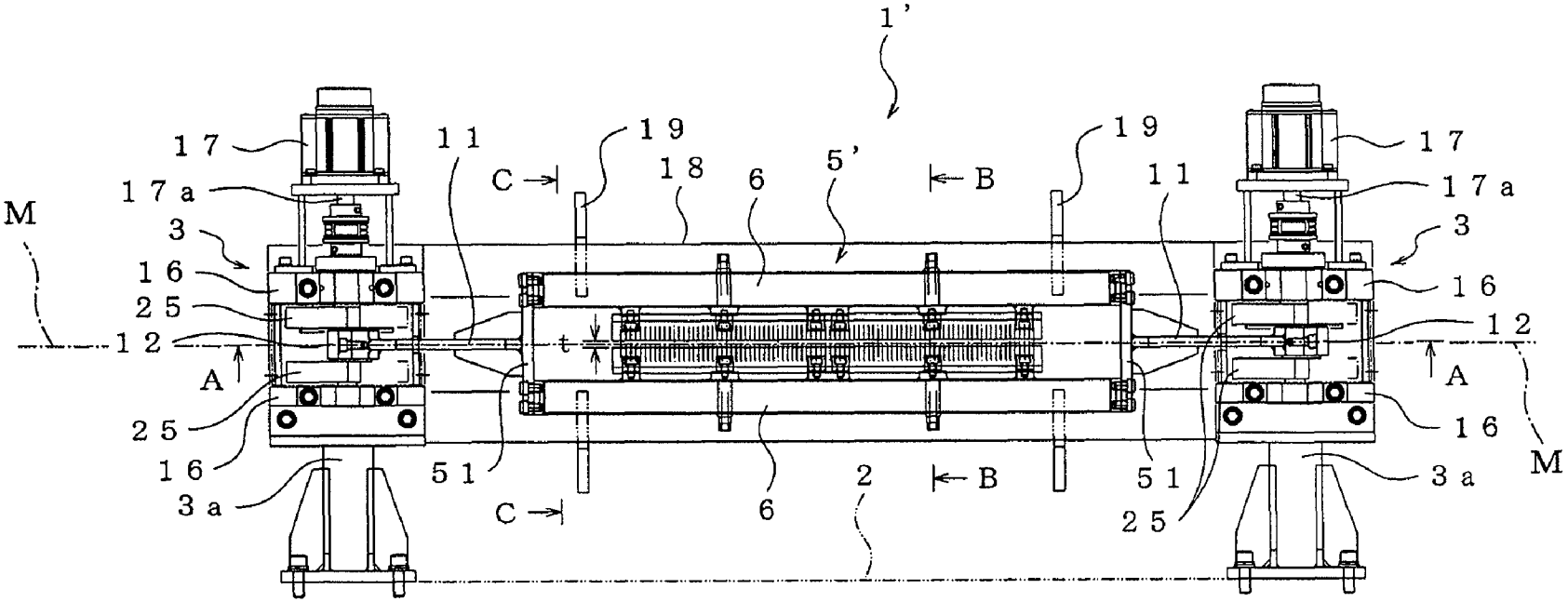
FIG. 17 is a front view of a high-pressure water cleaning system according to a second embodiment of the present invention, which is illustrated as being partly in cross-section.
Figure 18:
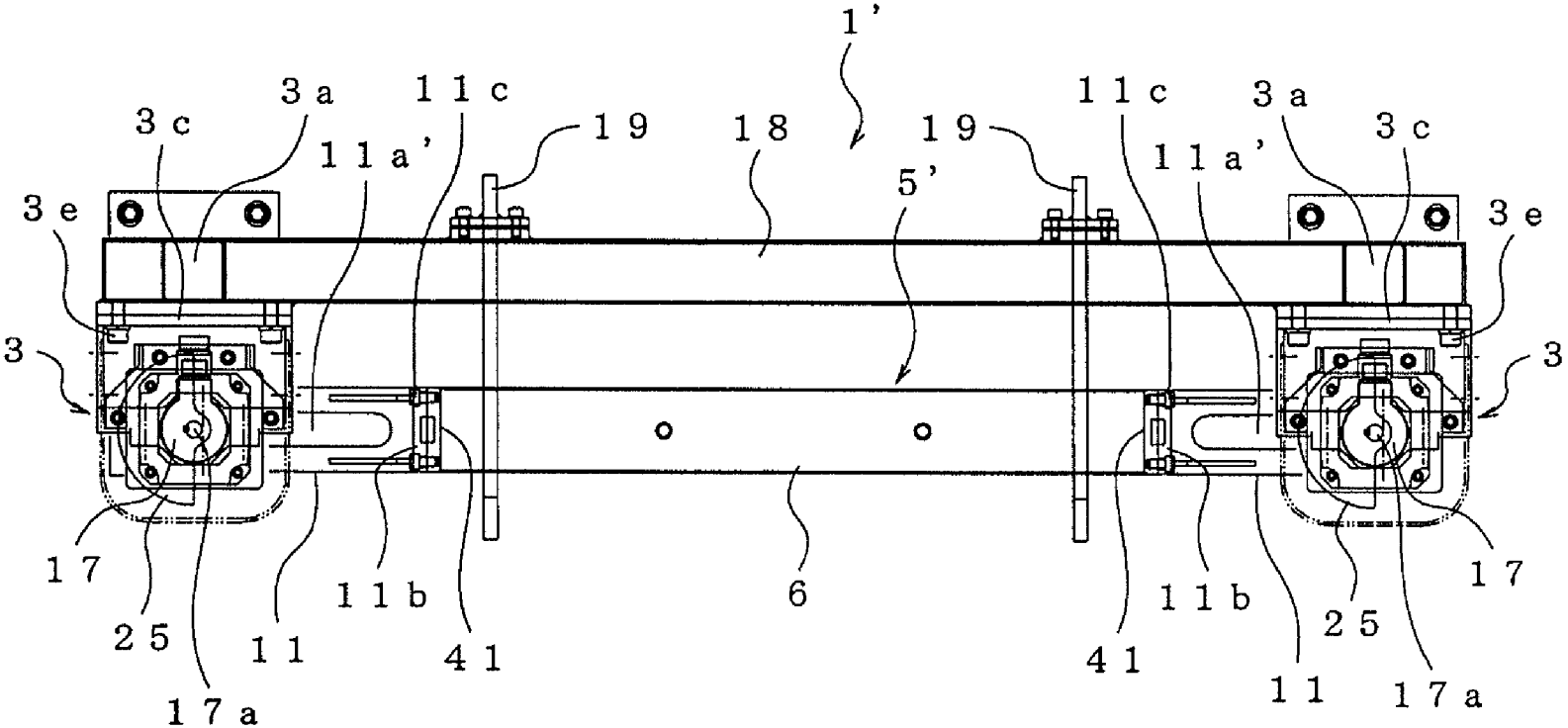
FIG. 18 is a plan view of the high-pressure water cleaning system according to the second embodiment of the present invention.
Figure 19:
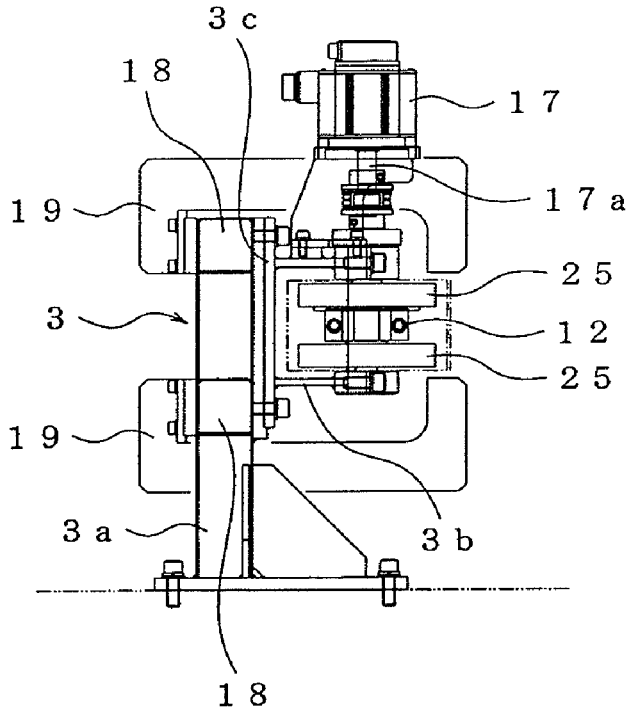
FIG. 19 is a left side view of the high-pressure water cleaning system according to the second embodiment of the present invention.
Figure 20:
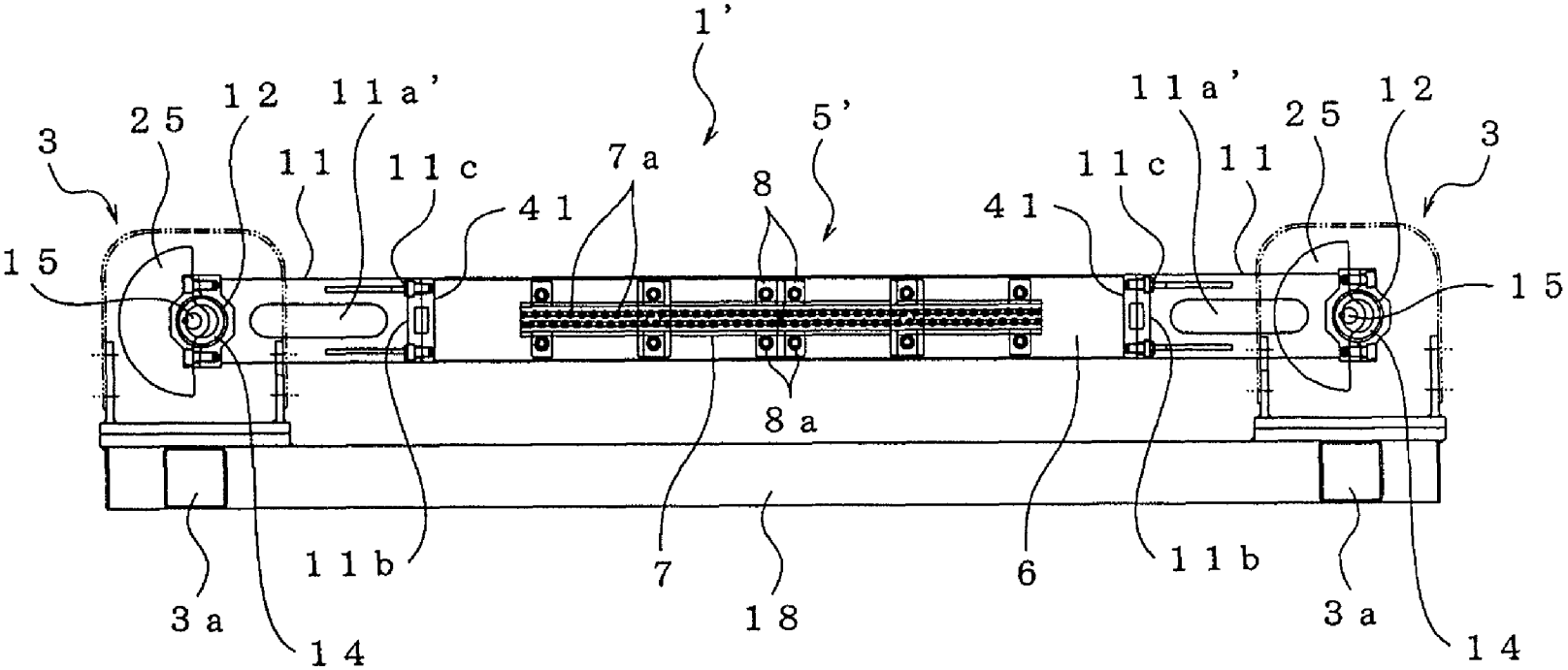
FIG. 20 is a cross-sectional view taken along line A-A of FIG. 17.
Figure 21:
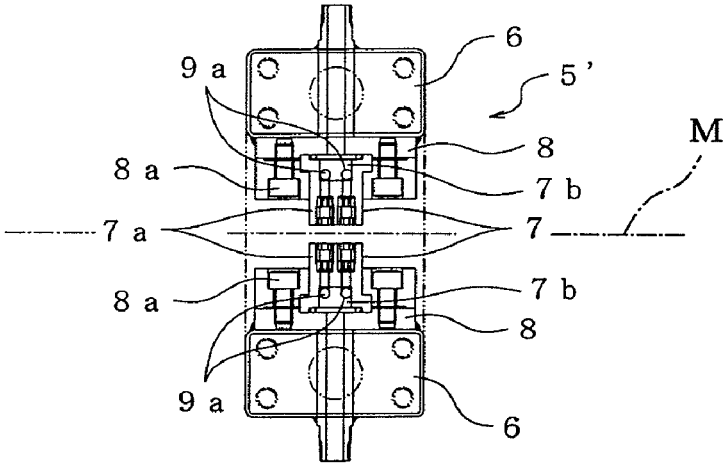
FIG. 21 is a cross-sectional view taken along line B-B of FIG. 17.
Figure 22:
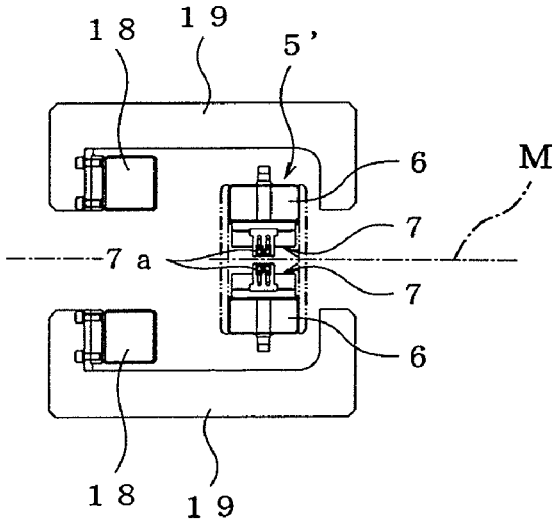
FIG. 22 is a cross-sectional view taken along line C-C of FIG. 17.

As shown in FIG. 18, the coupling plate 11 is provided with an opening 11*a*' of an elongated circle shape for the purpose of lightweight. As shown in FIG. 17, the ring-shaped bearing housing 12 is integrally coupled to one end (outer end) of each coupling plate 11. The cylindrical rotational shaft eccentric member 14 is rotatably mounted by the bearing 13 within the bearing housing 12. The upper and lower rotational shafts 15 (as in FIG. 6A) are rotatably supported by the support base 3 via the bearing housing 12 and are coupled to each other in a position eccentric from the center of the rotational shaft eccentric member 14 such that the rotational shafts 15 are integrally rotatable with the rotational shaft eccentric member 14. The servo motor 17 causes the rotational shafts 15 to rotate substantially in synchronization, causing cleaning main body 5' to perform the rotational motion so that each of the plurality of nozzles 7*a* is rotated to draw the perfect circle.

The nozzle head units 7, each of which is provided with nozzles 7*a* arranged in a zigzag shape, equally spaced apart from each other and forming two lines, are attached opposite the inner surfaces of the upper and lower support frame members 6. As shown in FIG. 17, in the present embodiment, a gap t is provided between the tip end surfaces of the upper and lower nozzles 7*a* to enable the object X to pass therethrough and thus be subjected to, at both surfaces thereof, the high-pressure water ejected from the nozzles 7*a*. The numeric value of the gap t is not particularly limited. For example, when the object X is a thin flat plate material such as a semiconductor wafer, having a relatively small thickness, the gap t is approximately between ten mm and fifteen mm. As shown in FIG. 16 and FIGS. 18-20, the support frame members 6 of an equal weight and the nozzle head units 7 of an equal weight are disposed at opposite sides, i.e., upper and lower sides with respect to a center axis M in the width direction of the cleaning main body 5'. This eliminates a need for the counterweight 21 mounted to maintain a balance of the cleaning main body 5 and the brackets 22 used for mounting the counterweight 21 in the high-pressure water cleaning system 1. Nonetheless, the upper and lower counterweights 25 mounted to the upper and lower rotational shafts 15 with the rotational shaft eccentric member 14 interposed therebetween of the high-pressure water cleaning system 1 are provided in the high-pressure water cleaning system 1' to cancel the moment generated when the cleaning main body 5' is performing the eccentric rotational motion. A pair of right and left protective frame members 19 are mounted to the cleaning main body 5' such that they are disposed in upper and lower positions to be spaced apart from each other in the longitudinal direction of a pair of the upper and lower cross beams 18. The protective frame members 19 cover the upper and lower parts of the cleaning main body 5'.

The same reference numerals as those in the high-pressure water cleaning system 1 are used to identify other components or members in the high-pressure water cleaning system 1' of the second embodiment. The cleaning chamber 30 and the sealing devices at the insertion openings 31 in the high-pressure water cleaning system 1 of the first embodiment are the same as those of the high-pressure water cleaning system 1' of the second embodiment and will not be redescribed for sake of brevity.

Whereas the two servo motors 17 are used in the above described high-pressure water cleaning systems 1 and 1', one servo motor 17 may be provided, and the driving force may be transmitted from the servo motor 17 on one side to the rotational shaft 15 on the other side, via for example, a transmission belt.

In the above described embodiments, the object X is moved horizontally and is cleaned by the high-pressure water ejected from the nozzles 7*a* or 7*a*.' The attitude of the object X may be varied from horizontal to vertical.

Whereas in the above described embodiments, the support frame members 6 are formed by hollow frame members of a tubular shape with a rectangular cross-section for the purpose of lightweight, they may be formed by plate-shaped frame members.

Furthermore, the high-pressure water cleaning systems 1 or 1' may be combined with a cleaning gun disclosed in Japanese Patent No. 2705719, which is herein incorporated by reference.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A high-pressure water cleaning system, having a cleaning main body, the cleaning system being configured to eject high-pressure water from the cleaning main body to an object to clean the object, while moving the object at a constant speed with respect to the cleaning main body, comprising:

a support frame member having a length which is larger than a width of the object, the support frame member being supported at extended end portions thereof at both sides by bearing units and eccentric rotational shafts extending in a direction perpendicular to a surface of an extended plane of the support frame member such that the support frame member is eccentrically rotatable, the eccentric rotatable shafts being configured to rotate to cause the support frame member to perform rotational motion;

a plurality of high-pressure water ejecting nozzles which are arranged on the surface of the support frame member to be equally spaced apart from each other and are directed to face the object; and a drive device configured to cause the eccentric rotational shafts to rotate;

wherein the high-pressure water ejecting nozzles are supplied with the high-pressure water through a water passage extending along the support frame member and are configured to eject the high-pressure water to the object being moved at the constant speed while performing the rotational motion.

2. The high-pressure water cleaning system according to claim 1, further comprising:

a second drive device configured to cause the eccentric rotational shafts to rotate; and an eccentric rotation drive apparatus disposed outside a cleaning area of the object, and including at least one of the drive devices provided at each of the extended end portions of the support frame member.

3. The high-pressure water cleaning system according to claim 1, wherein each of the high-pressure water ejecting nozzles has a nozzle hole which is formed in a center position thereof to extend in a direction perpendicular to a tip end surface thereof; and wherein one end of a high-pressure water supply passage extending along the support frame member is coupled to a base end side of the nozzle holes of the high-pressure water ejecting nozzles, and an opposite end of the high-pressure water supply passage is coupled to a high-pressure water source via a flexible metal-made pipe.

4. The high-pressure water cleaning system according to claim 1, further comprising:

a balance weight mounted to one surface of the support frame member which is opposite to the other surface of the support frame member on which the high-pressure water ejecting nozzles are provided so that a weight of an upper part and a weight of a lower part including the high-pressure water ejecting nozzles are balanced, the upper part and the lower part being defined by a center axis in a width direction of the support frame member.

5. The high-pressure water cleaning system according to claim 1, further comprising:

a second drive device configured to cause the eccentric rotational shafts to rotate;

an eccentric rotation drive apparatus including at least one of the drive devices provided at each of the extended end portions of the support frame member;

a rotational shaft eccentric member for at least one of the bearing units, the rotational shaft eccentric member being configured to couple an upper shaft and a lower shaft of a corresponding one of the eccentric rotational shafts in a position eccentric from a center axis of the rotational shaft eccentric member such that the upper shaft and the lower shaft of the corresponding one of the eccentric rotational shafts are integrally rotatable with the rotational shaft eccentric member; and a bearing housing unit of at least one of the bearing units, the bearing housing unit being configured to rotatably support the rotational shaft eccentric member; and wherein the bearing housing unit is integrally coupled to one end of the support frame member via the coupling plate.

6. The high-pressure water cleaning system according to claim 5, wherein the rotational shaft eccentric member is formed in a cylindrical shape, and the upper shaft and the lower shaft of the corresponding one of the eccentric rotational shafts are coupled to each other within the bearing housing unit in the position eccentric from the center axis of the cylindrical rotational shaft eccentric member such that the corresponding one of the eccentric rotational shafts is integrally rotatable with the rotational shaft eccentric member.

7. The high-pressure water cleaning system according to claim 6, further comprising:

balance weights which are mounted to the upper shaft and lower shaft of the corresponding one of the eccentric rotational shafts to be integrally rotatable with the corresponding one of the eccentric rotational shafts, and are mounted at upper and lower positions with the eccentric rotational shaft member and the bearing housing unit interposed between the balance weights such that the balance weights are located on an opposite side of the center axis of the rotational shaft eccentric member with respect to a center axis of the corresponding one of the eccentric rotational shafts in an eccentric direction of the support frame member to maintain a balance with a centrifugal force of the support frame member.

8. The high-pressure water cleaning system according to claim 5, further comprising:

a cleaning chamber surrounding a cleaning area of the object; and first insertion openings provided on both end walls of the cleaning chamber, the coupling plates being respectively inserted into the first insertion openings;

wherein a surrounding region of each of the first insertion openings is coupled to one of both opening peripheries of a bag-shaped bellows-like sealing member, and a part of a periphery of the coupling plate protruding from each of the first insertion openings is coupled to the other one of the opening peripheries of the bag-shaped bellows-like sealing member.

9. The high-pressure water cleaning system according to claim 5, further comprising:

a cleaning chamber surrounding a cleaning area of the object;

first insertion openings respectively provided on each of the end walls of the cleaning chamber, the coupling plates being respectively inserted into the first insertion openings;

sealing chambers which are respectively provided outside the first insertion openings, the sealing chambers each being configured to surround an associated one of the first insertion openings and a part of an associated one of the coupling plates protruding from the associated first insertion opening;

second insertion openings respectively provided on side end walls of the sealing chambers, the coupling plates being each inserted into both an associated one of the first insertion openings and an associated one of the second insertion openings;

exhaust outlets respectively formed on upper walls of the sealing chambers; and a pair of sealing members which are in a U-shape and in a leaf spring shape and are disposed in the vicinity of an associated one of the first insertion openings and an associated one of the second insertion openings within the sealing chamber, the sealing members being disposed such that one end of each of the sealing members is fixed to an inner wall of the sealing chamber and both side surfaces of the coupling plate are slidably in contact with open end portions of the sealing members.

10. The high-pressure water cleaning system according to claim 5, further comprising:

a cleaning chamber surrounding a cleaning area of the object;

first insertion openings provided on both end walls of the cleaning chamber, the coupling plates being respectively inserted into the first insertion openings; and fixed-type sealing chambers having a double tube structure and having openings respectively connected to the first insertion openings in the longitudinal direction, the fixed-type sealing chambers each including an inner tube which opens at both ends thereof and an outer tube which opens at one end thereof and is configured to surround the inner tube to be spaced apart from the inner tube;

wherein the inner tube is perforated to form a number of holes, and the outer tube is perforated to form a plurality of holes; and wherein an open end portion of the outer tube is connected to an end wall of the cleaning chamber such that the first insertion opening is connected to an opening of the inner tube.

11. The high-pressure water cleaning system according to claim 5, further comprising:

a cleaning chamber surrounding a cleaning area of the object;

first insertion openings provided on both end walls of the cleaning chamber, the coupling plates being respectively inserted into the first insertion openings; and fixed-type sealing chambers having a double tube structure and having openings respectively connected to the first insertion openings in the longitudinal direction, the fixed-type sealing chambers each including an inner tube which opens at both ends thereof and an outer tube which opens at one end thereof and is configured to surround the inner tube to be spaced apart from the inner tube;

wherein the inner tube is perforated to form a number of holes, and the outer tube is perforated to form a plurality of holes; and wherein an open end portion of the outer tube is connected to an end wall of the cleaning chamber such that the first insertion opening is connected to the opening of the inner tube.

12. A high-pressure water cleaning system, having a cleaning main body, the cleaning system being configured to eject high-pressure water from the cleaning main body to both surfaces of an object to clean the object, while moving the object at a constant speed with respect to the cleaning main body, comprising:

a pair of support frame members each having a length which is larger than a width of the object, the support frame members being disposed in parallel with a center axis in a thickness direction of the cleaning main body interposed between the pair of support frame members;

a plurality of high-pressure water ejecting nozzles which are arranged on opposite surfaces of the support frame members which face each other, and wherein the ejecting nozzles are equally spaced apart from each other and the ejecting nozzles on the opposite surfaces are opposite to each other; and coupling plates integrally coupled to both end portions of each of the support frame members so as to extend laterally outward along the center axis in the width direction of the cleaning main body, the coupling plates being each eccentrically rotatably supported at an end portion thereof by a bearing unit and eccentric rotational shafts extending in a direction perpendicular to a surface of the coupling plate;

a drive device configured to cause the eccentric rotational shafts to rotate to cause the support frame members to perform rotational motion;

wherein the high-pressure water ejecting nozzles are supplied with the high-pressure water through a water passage extending along the support frame members and are configured to eject the high-pressure water to both surfaces of the object being moved at the constant speed while performing the rotational motion.

13. The high-pressure water cleaning system according to claim 12, further comprising:

a second drive device configured to cause the eccentric rotational shafts to rotate to cause the support frame members to perform rotational motion; and an eccentric rotation drive apparatus disposed outside a cleaning area of the object, and including at least one of the drive devices provided at an end portion of each of the coupling plates.

14. The high-pressure water cleaning system according to claim 12, wherein each of the high-pressure water ejecting nozzles has a nozzle hole which is formed in a center position thereof to extend in a direction perpendicular to a tip end surface thereof; and wherein one end of a high-pressure water supply passage extending along the support frame members is coupled to a base end side of the nozzle holes of the high-pressure water ejecting nozzles, and an opposite end of the high-pressure water supply passage is coupled to a high-pressure water source via a flexible metal-made pipe.

15. The high-pressure water cleaning system according to claim 12, further comprising:

a second drive device configured to cause the eccentric rotational shafts to rotate to cause the support frame members to perform rotational motion; and an eccentric rotation drive apparatus including at least one of the drive devices provided at an end portion of each of the coupling plates, a rotational shaft eccentric member which is configured to couple the upper shaft and the lower shaft of a corresponding one of the eccentric rotational shafts in a position eccentric from a center axis of the rotational shaft eccentric member such that the corresponding one of the eccentric rotational shafts is integrally rotatable with the rotational shaft eccentric member, and wherein each bearing unit includes a bearing housing unit configured to rotatably support a corresponding one of the rotational shaft eccentric members; and wherein each bearing housing unit is integrally coupled to one end of the support frame member via the coupling plate.

16. The high-pressure water cleaning system according to claim 15, wherein the rotational shaft eccentric member is formed in a cylindrical shape, and the upper shaft and the lower shaft of the corresponding one of the eccentric rotational shafts are coupled to each other within a corresponding one of the bearing housing units in the position eccentric from the center axis of the cylindrical rotational shaft eccentric member such that the upper shaft and the lower shaft of the corresponding one of the eccentric rotational shafts are integrally rotatable with the rotational shaft eccentric member.

17. The high-pressure water cleaning system according to claim 16, further comprising:

balance weights which are mounted to the upper shaft and the lower shaft of the corresponding one of the eccentric rotational shafts to be integrally rotatable with the corresponding one of the eccentric rotational shafts and are mounted at upper and lower positions with the eccentric rotational shaft member, and wherein a corresponding one of the bearing housing units is interposed between the balance weights such that the balance weights are located on an opposite side of the center axis of the rotational shaft eccentric member with respect to a center axis of the corresponding one of the eccentric rotational shafts in an eccentric direction of the support frame member to maintain a balance with a centrifugal force of the support frame member.

18. The high-pressure water cleaning system according to claim 12, further comprising:

a cleaning chamber surrounding a cleaning area of the object; and first insertion openings provided on both end walls of the cleaning chamber, the coupling plates being respectively inserted into the first insertion openings;

wherein a surrounding region of each of the first insertion openings is coupled to one of both opening peripheries of a bag-shaped bellows-like sealing member and a part of a periphery of the coupling plate protruding from each of the first insertion openings is coupled to the other one of the both opening peripheries of the bag-shaped bellows-like sealing member.

19. The high-pressure water cleaning system according to claim 12, further comprising:

a cleaning chamber surrounding a cleaning area of the object;

first insertion openings provided on both end walls of the cleaning chamber, the coupling plates being respectively inserted into the first insertion openings;

sealing chambers which are respectively provided outside the first insertion openings, the sealing chambers being each configured to surround an associated one of the first insertion openings and a part of an associated one of the coupling plates protruding from the associated first insertion opening;

second insertion openings respectively provided on side end walls of the sealing chambers, the coupling plates being each inserted into both of an associated one of the first insertion openings and an associated one of the second insertion openings;

exhaust outlets respectively formed on upper walls of the sealing chambers; and a pair of sealing members which are in a U-shape and in a leaf spring shape and are disposed in the vicinity of an associated one of the first insertion openings and an associated one of the second insertion openings within the sealing chamber, the sealing members being disposed such that one end of each of the sealing members is fixed to an inner wall of the sealing chamber and both side surfaces of the coupling plate are slidably in contact with open end portions of the sealing members.

* * * * *